US010919092B2

(12) United States Patent
Demers et al.

(10) Patent No.: US 10,919,092 B2
(45) Date of Patent: Feb. 16, 2021

(54) LOW-PRESSURE POWDER INJECTION MOLDING MACHINE, KIT AND METHOD

(71) Applicant: ÉCOLE DE TECHNOLOGIE SUPÉRIEURE, Montreal (CA)

(72) Inventors: Vincent Demers, Verdun (CA); Simon G. Lamarre, Saint-Constant (CA); Jean-François Chatelain, Longueuil (CA)

(73) Assignee: ÉCOLE DE TECHNOLOGIE SUPÉRIEURE, Montreal (CA)

( * ) Notice: Subject to any disclaimer, the term of this patent is extended or adjusted under 35 U.S.C. 154(b) by 236 days.

(21) Appl. No.: 16/097,328

(22) PCT Filed: May 1, 2017

(86) PCT No.: PCT/CA2017/050526
§ 371 (c)(1),
(2) Date: Oct. 29, 2018

(87) PCT Pub. No.: WO2017/185189
PCT Pub. Date: Nov. 2, 2017

(65) Prior Publication Data

US 2019/0134712 A1 May 9, 2019

Related U.S. Application Data

(60) Provisional application No. 62/329,419, filed on Apr. 29, 2016.

(51) Int. Cl.

| | |
|---|---|
| ***B22F 3/22*** | (2006.01) |
| ***B28B 1/24*** | (2006.01) |
| ***B28C 5/46*** | (2006.01) |

(52) U.S. Cl.
CPC ..... *B22F 3/225* (2013.01); *B28B 1/24* (2013.01); *B28C 5/464* (2013.01)

(58) Field of Classification Search
CPC ... B28B 1/24; B28B 1/54; B22F 3/225; B22F 3/22; B22F 2998/00
See application file for complete search history.

(56) References Cited

U.S. PATENT DOCUMENTS

| | | | |
|---|---|---|---|
| 4,734,237 | A | 3/1988 | Fanelli et al. |
| 5,121,329 | A | 6/1992 | Crump |

(Continued)

FOREIGN PATENT DOCUMENTS

| | | | |
|---|---|---|---|
| KR | 10-2010-0114646 | A | 10/2010 |
| WO | WO 2005/102663 | A1 | 11/2005 |

OTHER PUBLICATIONS

PCT/CA2017/050526 IPRP.
PCT/CA2017/050526 ISR.
PCT/CA2017/050526 written opinion.

*Primary Examiner* — Joseph S Del Sole
*Assistant Examiner* — Mohamed K Ahmed Ali
(74) *Attorney, Agent, or Firm* — Anglehart et al.

(57) ABSTRACT

A low-pressure powder injection molding machine, a kit and a method thereof. The machine has a feedstock container adapted to contain mixed feedstock, a mold and an injection device. The mold has an inlet and a cavity in which the feedstock material can set. The injection device has an injection port for supplying the mixed feedstock from the container to the mold by using pressure. The machine also has a moveable platform adapted to provide movement between the injection port of the injection device and the inlet of the mold in order to directly communicate the feedstock between the injection port and the inlet without using an intermediate conduit and thereby preventing any feedstock from setting or dissociating between the injection port and the inlet.

20 Claims, 26 Drawing Sheets

(56) References Cited

U.S. PATENT DOCUMENTS

| | | | | |
|---|---|---|---|---|
| 5,403,178 | A * | 4/1995 | Steger | B28B 1/24 425/557 |
| 6,352,427 | B1 * | 3/2002 | Hahn | B29C 45/16 264/328.11 |
| 2002/0058136 | A1 | 5/2002 | Belhadjhamida | |
| 2004/0253429 | A1 | 12/2004 | Polk, Jr. et al. | |
| 2005/0074516 | A1 * | 4/2005 | Coscia | B29C 45/54 425/574 |
| 2006/0159793 | A1 * | 7/2006 | Hahn | B29C 45/16 425/145 |
| 2011/0189440 | A1 | 8/2011 | Appleby et al. | |
| 2012/0292826 | A1 * | 11/2012 | Ueha | B29C 45/73 264/403 |

* cited by examiner

LOW-PRESSURE POWDER INJECTION MOLDING MACHINE, KIT AND METHOD

CROSS-REFERENCE TO RELATED APPLICATIONS

The present application claims benefit from the U.S. provisional patent application Ser. No. 62/329,419 filed on Apr. 29, 2016, entire contents of which are incorporated herein by reference.

TECHNICAL FIELD

The present invention relates to the field of low-pressure powder injection molding, and more specifically to low-pressure powder injection molding machines, kits and methods.

BACKGROUND

High-pressure powder injection molding (HPIM) is a manufacturing process consisting in mixing metallic or ceramic powder with a molten polymeric binder to obtain a feedstock which is injected at high pressure into a mold cavity to generate a complex shape. Reciprocating screw molding machine is generally used to reach the high pressure required in conventional power injection molding (PIM). During debinding and sintering treatments, the binder is completely removed to obtain a near-net shape dense metallic component. Key features of HPIM process are low production costs, shape complexity, tight tolerances, applicability to several materials, and high final properties.

Low-pressure powder injection molding (LPIM) is a variant of the conventional HPIM process in which recent progress in feedstock formulations has generated new opportunities for producing shapes of higher complexity that is yet cost-effective, either in high or in low production volumes. A pneumatic molding machine is generally used to fill a mold cavity with a powder-binder mixture. Initially used in ceramics forming, the LPIM technology has quickly become attractive for the development of high value-added metallic parts. A key to the successful injection of feedstock at low-pressure lies in the low-viscosity properties of the wax-based binder. However, the relatively low feedstock viscosity may promote segregation of powder-binder mixture. Segregation refers to the inhomogeneous distribution of powder particles in feedstocks. Such segregation is mainly generated by gravity, an improper mixing method, or a high-pressure gradient, before or during the molding process. The latter must be minimized in order to prevent distortions, cracks, voids, warping and heterogeneous shrinkage of the sintered parts.

As presented in prior art FIG. 1A, molding machines 10 for LPIM generally have a mold 12, a feedstock tank 14 or container and an interconnecting injection pipe 16 or injection channel. As feedstock or feedstock ingredients are introduced in the tank 14, a mixer 18 of the tank constantly mixes the molten feedstock 20 in order to prevent segregation in the feedstock. Moreover, heat is applied to the tank 14 as well as to the injection pipe 16 in order to maintain a desired feedstock viscosity. When air pressure is introduced into the tank, the molten feedstock is forced out of the tank through the interconnecting injection pipe 16 and into a cavity 22 of the mold 12.

For instance, U.S. Pat. No. 4,416,603 to Peltsman et al. shows such a conventional low-pressure injection molding machine for metallic or ceramic powder. However, with the conventional low-pressure injection molding machine, trapped feedstock in the injection pipe 16 remains idle, between injections, since mixing of the feedstock in the injection pipe 16 is not possible, as presented in the prior art FIG. 1. The idle feedstock within the injection pipe can deteriorate, for instance, segregation of the feedstock in the injection pipe 16 can occur particularly with feedstock having low viscosity and produce a feedstock that is inappropriate for injecting into the mold.

U.S. Pat. No. 5,795,601 to Yamada et al. describes a LPIM machine having a system to prevent air from being entrapped in the feedstock during injection. A proportional pump is connected to a discharge port of a feedstock tank for supplying the feedstock at a constant rate to a mold via a feeder pipe and a cylinder. The cylinder opens into the mold and is connected to the proportional pump through the feeder pipe for being supplied with the feedstock. Injection in the mold cavity is performed by a plunger of the cylinder. However cleaning of this system can be problematic, considering that powder can be trapped in joints and contaminate following feedstocks. Also, problems can occur when used with low viscosity feedstock, because dead time between each injection can cause segregation of the feedstock in the interconnecting feeder pipe.

Therefore, there is a need for a LPIM that avoids contamination and segregation of feedstocks between injections while still preventing air from being entrapped in the feedstock during the mixing and the injection.

SUMMARY

According to one aspect there is a low-pressure powder injection molding machine having a feedstock container adapted to contain mixed feedstock, a mold and an injection device. The mold has an inlet and a cavity in which the feedstock material can set. The injection device has an injection port for supplying the mixed feedstock from the container to the mold by using pressure. The machine also has a moveable platform adapted to provide movement between the injection port of the injection device and the inlet of the mold in order to directly communicate the feedstock between the injection port and the inlet without using an intermediate conduit and thereby preventing any feedstock from setting or dissociating between the injection port and the inlet.

According to one aspect there is a low-pressure powder injection molding machine having a base structure, an injection device, a mold, a container and a mixer. The base structure has a moveable platform that is displaceable along a platform displacement path. The injection device is mounted on the moveable platform and has an injection cylinder that is adapted to fill up, at least in part, with a feedstock when in a container alignment position and that is adapted to inject the feedstock when in a mold alignment position according to a piston movement within the injection cylinder. The mold is placeable on the moveable platform and immobilized with respect to the base structure along the platform displacement path when the injection device is in a mold alignment position, the mold has an inlet and a cavity, the inlet is in communication with the cavity for transmitting the feedstock from the injection cylinder to the cavity, the inlet being positioned to align with the injection cylinder when in the mold alignment position. The container is placeable on the moveable platform and immobilized with respect to the base structure along the platform displacement path. The container defines a chamber and an outlet that is in communication with the chamber. The outlet is positioned to align with the injection cylinder when in the container alignment position. The chamber is adapted to receive and contain at least one material to produce the feedstock and is further adapted to receive a mixing tool of a mixer for mixing the feedstock. The mixer is displaceably mounted on the base structure so as to engage the container with the mixing tool. According to another aspect, there is a low-pressure powder injection molding machine kit having a base structure, a moveable platform and an injection device. The moveable platform is mountable on the base. The platform defines a first side and an opposite second side and further defines a cylinder passage from the first side to the second side. The platform is moveable from a container alignment position to a mold alignment position in order to align the cylinder passage with an outlet of a container when the container is placed on the second side and with an inlet of a mold when the mold is placed on the second side, respectively. The injection device is mountable on the moveable platform at the first side. The injection device has a cylinder adapted to engage the cylinder passage and adapted to hold feedstock therein. The cylinder has a piston therein that is displaceable away from the moveable platform for admitting at least part of the feedstock from the container into the cylinder when the cylinder is in the container alignment position and displaceable toward the moveable platform for ejecting at least part of the feedstock from the cylinder when the cylinder is in the mold alignment position.

According to yet another aspect, there is a method of producing a molded part, the method consists of mixing a feedstock within a container, aligning an injection cylinder with an outlet of the container, filing the injection cylinder with the feedstock by displacing a piston of the cylinder away from the outlet, aligning the injection cylinder with an inlet of a mold and injecting the feedstock into the inlet by displacing the piston towards the inlet for transferring the feedstock within a mold cavity. Following a hardening of the feedstock in the mold, the molded part is retrieved for the mold.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 2:
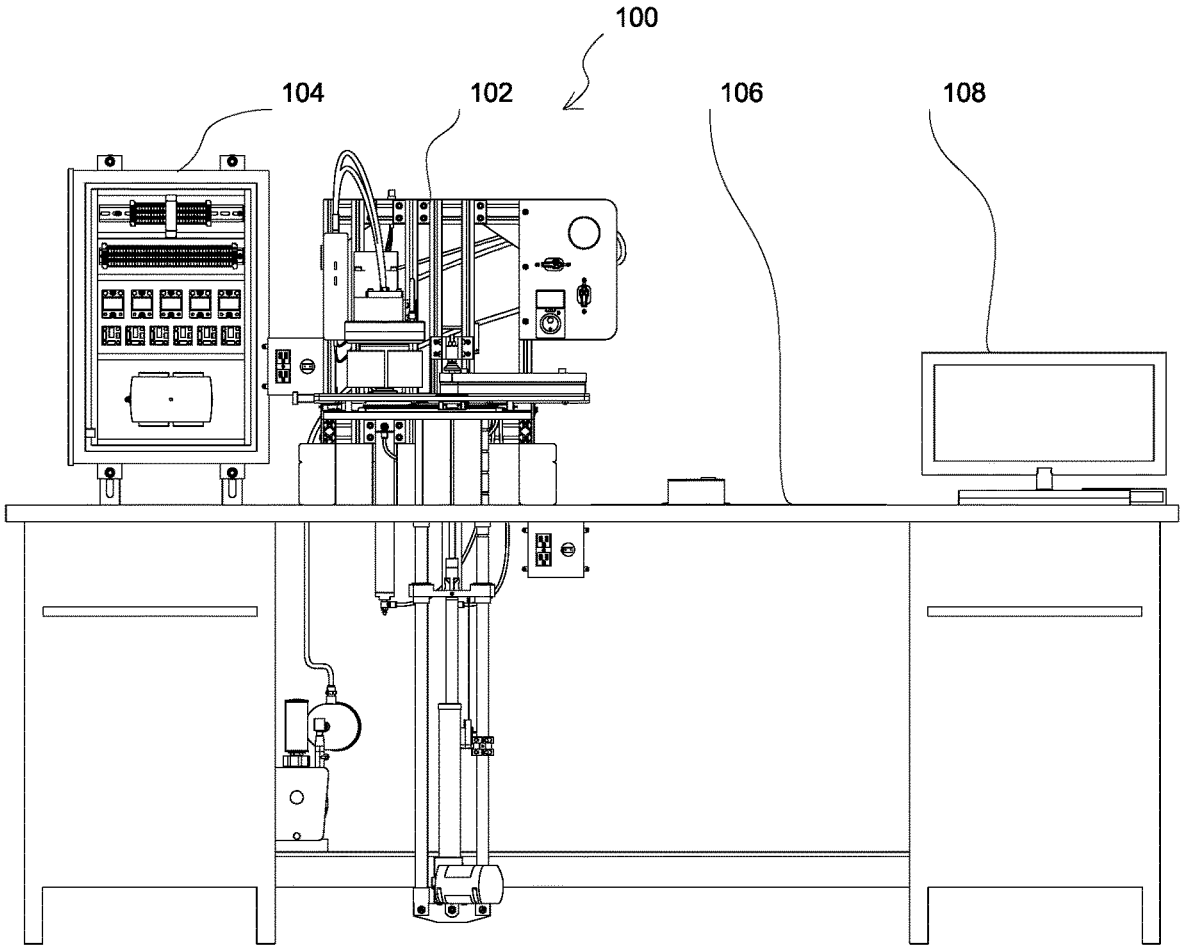
FIG. 2, illustrates an assembly of the low-pressure powder injection molding machine of FIG. 1B, according to one embodiment.

FIG. 2 presents an assembly of a low-pressure powder injection molding machine 100, according to one embodiment. The molding machine 100 is adapted to produce parts by injecting into an adapted mold a molten viscous mixture of a suitable powder and a suitable binder. Depending on the area of application and the requirements for the part, the powder is a ceramic powder or metallic powder and the binder is a polymeric binder such as a wax, a thermoplastic or a thermosetting resin with other additives such as surfactants, thickening agents, etc.

As further presented in FIG. 2 according to one embodiment, the molding machine 100 has a support table 106 adapted to support an injection system 102, various electronic components 104 and a monitor/input interface 108 (hereinafter: monitor 108) associated to a computer in order to allow a user to monitor and input control commands for controlling the injection system 102.

A skilled reader would understand that the injection system 102, the electronic components 104 and the monitor 108 could very well be positioned differently on the support table 106 or by a plurality of dedicated support tables 106 depending on the available space and preferences of the user. Moreover, the skilled reader will also understand that the electronic components 104 and the monitor 108 could further be remotely located and that the support table 106 could only be adapted to support the injection system 102.

It shall further be recognized that the injection system 102 can be supported by any other suitable type of support such as a support attached to a ceiling structure for suspending the injection system 102 or a rail structure providing mobility to the injection system 102.

Figure 3A:
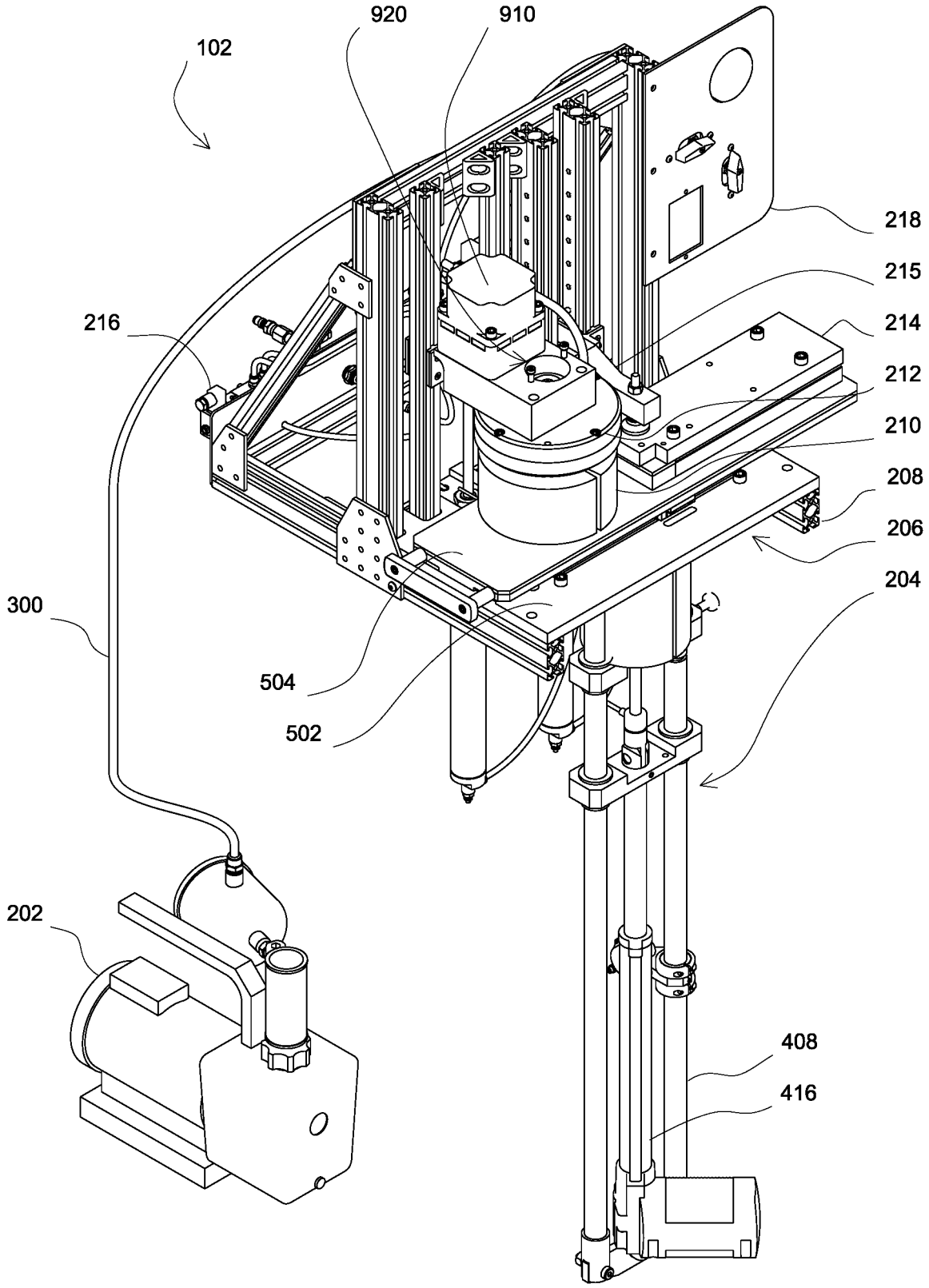
FIG. 3*a*, illustrates an injection system of the molding machine of FIG. 2, according to one embodiment.

Presented in FIG. 3*a* is a detailed view of the injection system 102. According to one embodiment, the injection system 102 has a base structure 208 adapted to operatively support a table 206, a mixer 212 and a mold holder 215. The table 206 is fixedly mounted on the base structure 208 and has a fixed platform 502 and an opposite sliding platform 504. In this embodiment the sliding platform 504 is slidable from one position to another however other suitable movements of the sliding platform 504 are possible, such as being rotatable about a suitable axis from one position to another, without departing from the scope of the present injection system 102.

Further presented in FIG. 3*a*, the mixer 212 is slidably mounted on the base structure 208 in order to engage the feedstock container 210 and also to withdraw from the feedstock container 210. In FIG. 3*a*, the mixer 212 is mounted on the base structure 208 and is vertically displaceable from an engaged position to a retracted position with respect to the feedstock container 210. A skilled person will understand that any other suitable mechanism or structure for displacing the mixer 212 from the engaged position to the retracted position with respect to the feedstock container 210 is possible without departing from the spirit of the present injection system 102

Further presented in FIG. 3*a*, the mold holder 215 is an arm that is slidably mounted on the base structure 208 and is vertically movable from a holding position to a releasing position. When the arm 215 is in the holding position, in cooperation with the sliding platform 504 of the table 206, pressure of the arm 215 is exerted on the mold in order to hold it in place for injecting the feedstock therein. In this embodiment, the arm 215 in cooperation with the sliding platform 504 holds the mold in place by applying pressure at one end portion of the mold, it shall however be recognized that the arm 215 could apply pressure to any suitable portion of the mold in order to adequately hold the mold in place. When the arm 215 is in the releasing position, the mold can be removed and opened for retrieving the formed part therefrom. Note that any other suitable way of removably placing, mounting or holding the mold 214 in place for injecting the feedstock therein is possible. In an alternate embodiment, the mold 214 is mounted on the table 206 and is displaceable from a mold filling position to a part releasing position. In yet another embodiment, the mold 214 is mounted on the mold holder 215 and is displaceable from a mold filling position to a part releasing position.

Note that the feedstock container 210 shall be interpreted as being any type of suitable receptacle such as a tank or a chamber system that is adapted in material, shape and size to receive and mix therein any suitable feedstock for producing a feedstock that is suitable for injecting into the mold 214. For certainty, the container 210 is adapted to receive either a pre-mixed feedstock or feedstock ingredients that when mixed and heated produce the desired feedstock.

Further presented in FIG. 3*a* the injection device 204 is mounted on the sliding platform 504 such as to allow the injection device 204 to be displaced from the feedstock container 210 to the mold 214. The sliding platform 504 is slidably displaceable for displacing the injection device 204 and also for covering an outlet of the container 210 as the injection device 204 is being displaced from a container 210 alignment position to a mold 214 alignment position. The injection device 204 is displaced from the container 210 alignment position for filling the injection device 204 with feedstock to a mold alignment position for injecting the feedstock into the mold 214 and vice versa. The sliding platform 504 is slidably displaced with respect to the container that is maintained in position by the pressure exerted by the mixer 212 towards the sliding platform 504. As the sliding platform 504 is slidably displaced, the outlet of the container 210 is obstructed or covered by a surface of the sliding platform 504.

The sliding platform 504 not only acts a means for displacing the injection device but also acts as a container outlet cover when the injection device 204 is moved from the feedstock container 210 to the mold 214 and also when the injection device 204 is in a mold alignment position. The sliding platform 504 is adapted to prevent any feedstock to flow out of the container 210, without necessitating a valve. Advantageously, since the container can be closed off or capped without necessitating a valve, maintenance of the closing mechanism is limited, cleanliness is simplified, and contamination of the feedstock within the container is minimized. In conventional machines where a valve is used for closing a container, feedstock often manages to enter the valve mechanism and the valve must frequently be cleaned to function properly. Also, as feedstock often manages to enter the valve mechanism, the valve mechanism exposes the content of the container to solidified feedstock, segregated feedstock, or feedstock made from other ingredients thereby promoting contamination of the feedstock within the container.

Moreover, since the sliding platform 504 allows the injection device 204 to move from the feedstock container 210 to the mold 214 and vice versa, a pipe or channel connecting the container to the mold is not required. Therefore, idle feedstock between injections is limited and feedstock segregation is limited as well. The only feedstock that remains idle is the feedstock located within the injection device 204 when filled with a limited amount of feedstock, which is promptly injected into the mold. After the mold injection, any remaining feedstock within the injection device 204 is promptly returned into the container 210 for further mixing.

Figure 1A:
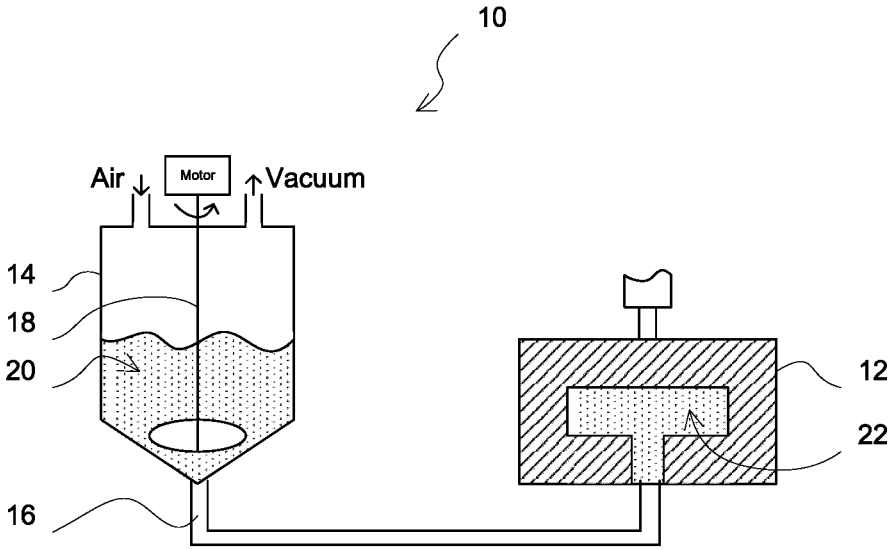
PRIOR ART Fig. 1A
FIG. 1A, schematically illustrates a low-pressure powder injection molding machine as found in the prior art.
Figure 1B:
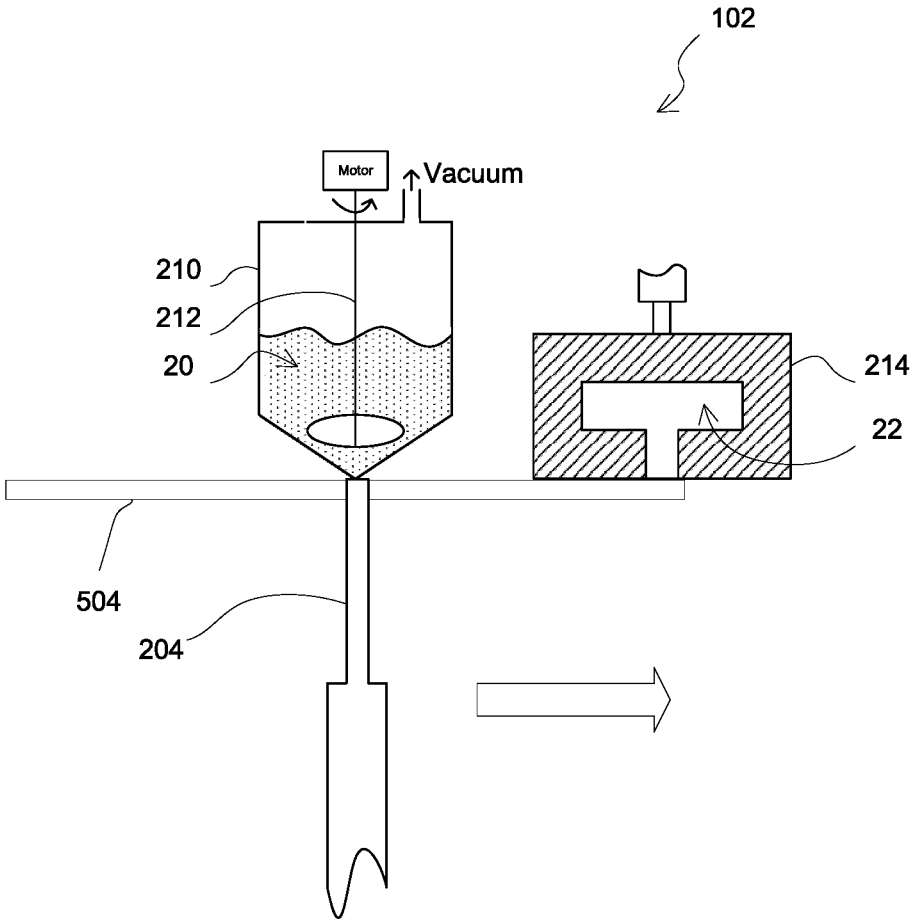
FIG. 1B, schematically illustrates a low-pressure powder injection molding machine having an injection device in a feedstock container alignment position, according to one embodiment.
Figure 1C:
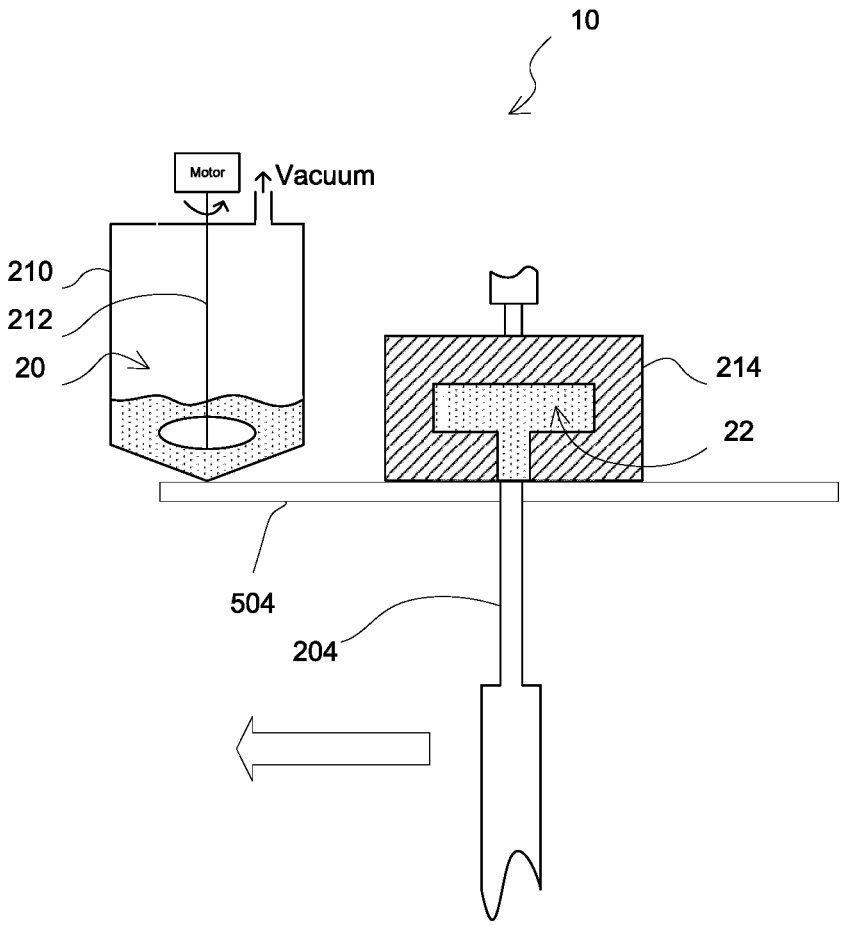
FIG. 1C, schematically illustrates the low-pressure powder injection molding machine of FIG. 1B having the injection device in a mold alignment position, according to one embodiment.

FIGS. 1B and 1C schematically illustrate the motion of the sliding platform 504. The sliding platform 504 provides lateral movement to the injection device 204 and allows the device 204 to align with an outlet of the feedstock container, as presented in FIG. 1B. When in the container alignment position, the device 204 can be charged with feedstock from the container 210. Once charged with feedstock, the sliding platform 504 provides lateral movement to the injection device 204 and allows the device 204 to align with an inlet of the mold, as presented in FIG. 1C. When in the mold alignment position, the device 204 discharges at least part of the feedstock into the mold. Remaining feedstock is returned into the container by sliding the platform 504 in order to position the injection device 204 into a container alignment position and discharges remaining feedstock back into the container for further use.

As the sliding platform 504 moves the injection device 204 away from the container alignment position, a contacting surface of the sliding platform prevents feedstock to flow out from the container, since the contacting surface is adapted to obstruct the outlet. This way, when the injection device 204 is in the mold alignment position, the contacting surface plugs the outlet of the container, as presented in FIG. 1C. As the sliding platform moves the injection device 204 away from the mold alignment position, the contacting surface of the sliding platform prevents feedstock from the mold that has been previously injected to flow back out or prevents any dust or debris to enter the mold cavity. As presented in FIG. 1B, when the injection device 204 is in the container alignment position, the contacting surface obstructs the inlet of the mold.

The sliding platform 504 has a dual purpose, it provides movement to the injection device 204 and also provides a closing mechanism for the container outlet as well as for the mold inlet. It shall however be recognized that the closing mechanism function of the sliding platform 504 could be replaced or used in combination with a valve located at the outlet of the container or with a valve located at an inlet of the mold, without departing from the present system 102.

It shall further be recognized that the injection device 204 could be integral with the container 210. In this case, the injection device 204 is part of the container 210 and the container 210 is mounted on the sliding platform in order to align with the mold. The mold being placed on the sliding platform on an opposite side with respect to the container. In one embodiment, the container is the injection cylinder and has an integrated piston adapted to push feedstock out of the container via the outlet when aligned with the inlet of the mold, in order to directly inject feedstock into the mold. In an alternate embodiment, the container has an air intake to blow air into the container and suitably push or propel the feedstock out of the container via the outlet when in the mold alignment position. As the container or injection device is moved away from the mold by the sliding platform, the opposite surface of the sliding platform obstructs the inlet of the mold and prevents any injected feedstock to flow out. In the container, any unused feedstock if remixed and the outlet of the container is shaped to allow proper remixing of the feedstock. For instance, the container could have a tapered bottom portion defining the outlet in order to facilitate the mixing of any remaining feedstock that is at the outlet.

It shall be recognized that in an alternate embodiment the injection device is integral with the container and the mold is mounted on the sliding platform. The container is placed on the sliding platform at an opposite side of the platform with respect to the mold. The mold is moveable in order to align with the outlet of the container and receive feedstock directly from the container.

Figure 3B:
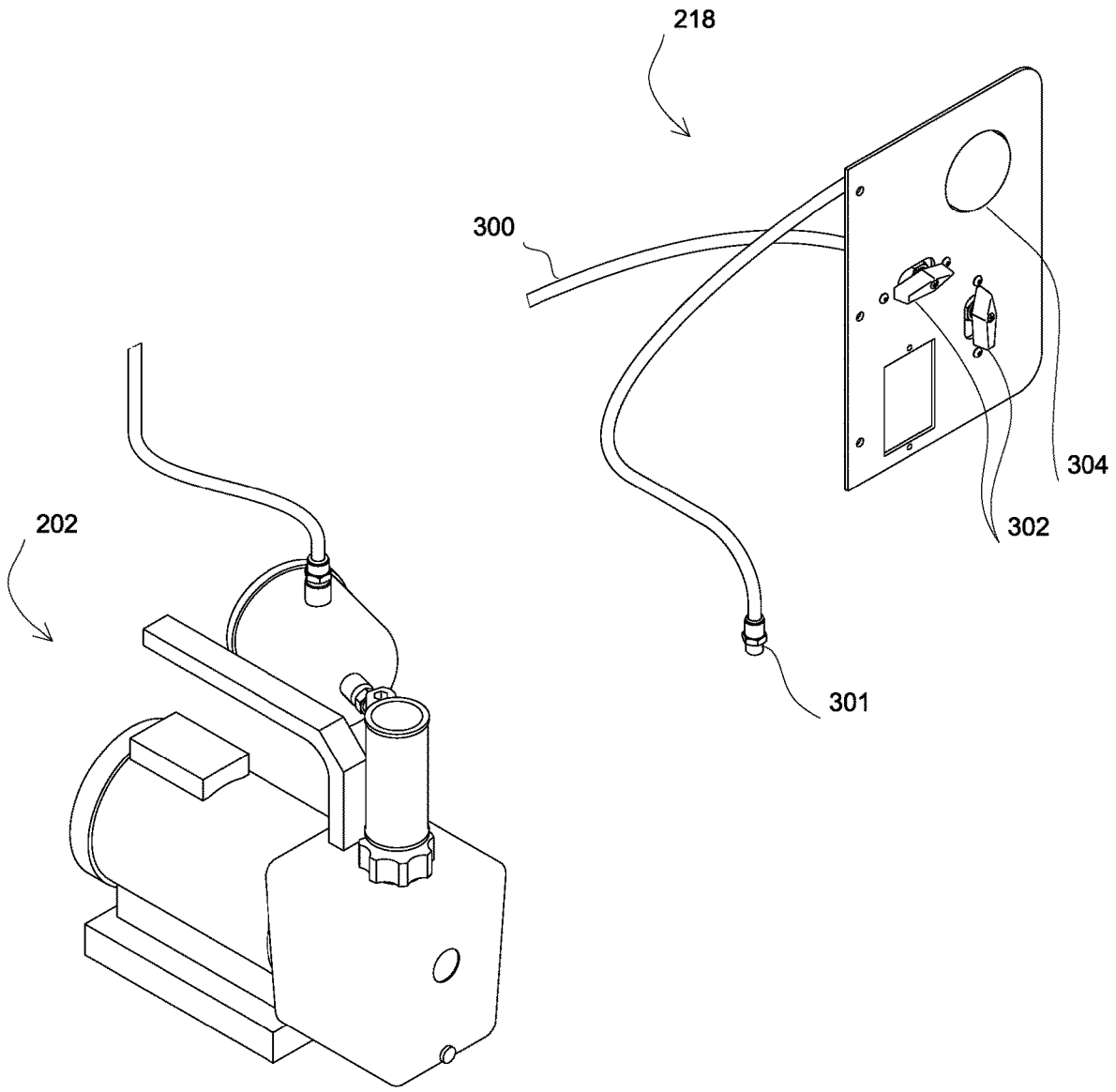
FIG. 3*b*, illustrates a vacuum system and a vacuum controller connectable to a feedstock container of the injection device of FIG. 3*a*, according to one embodiment.

Further presented in FIG. 3*a* and concurrently presented in FIG. 3*b*, there is a vacuum system 202 connected to a control panel 218 via hose 300 and to the feedstock container 210 via connectable hose 301, in order to remove air from the feedstock container 210 during a mixing operation and reduce the amount of air bubbles within the mixture. As presented in FIG. 3*b*, the control panel has two control valves 302 for controlling a vacuum pressure and a monometer 304 for indicating the pressure within the vacuum system 202.

Moreover, in this embodiment, the valve 302 is user operated and a user can directly control a vacuum pressure of the container 210, however it shall be understood that the valve 302 can also be at least in part controlled by a computer according to a user input or a predefined program.

It shall be understood that any other suitable means for controlling the vacuum pressure other than with the control valves 302 is possible. For instance, the vacuum pressure can be controlled electronically by a computer.

Moreover, a skilled person will understand that in some instances the vacuum system 202 is not required when a certain amount of air bubbles within the mixture is acceptable or when the mixing chamber 210 has an adapted shape that suitably provides evacuation of surplus air with ease.

Figure 4A:
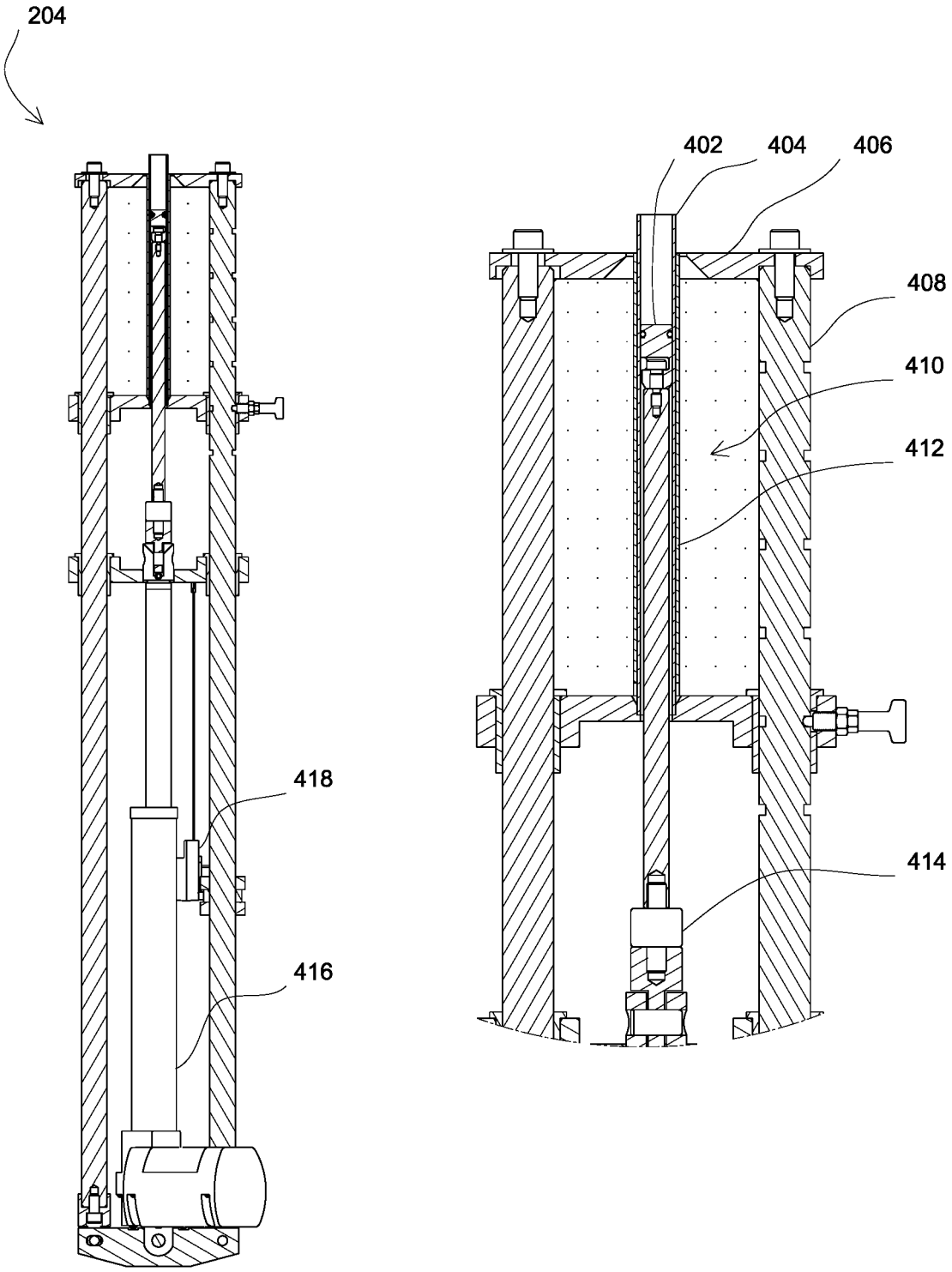
FIG. 4*a*, illustrates a partial section view of an injection cylinder of the injection device of FIG. 3*a*, according to one embodiment.

Presented in FIG. 4*a* is a sectioned view of the injection device 204, according to one embodiment. The injection device 204 has a cylinder 404 adapted to receive a piston 402 for charging and discharging, as with a syringe, the feedstock respectively from the feedstock container 210 to the mold 214. The piston 402 is activated by the electrical cylinder 416 that is maintained in place by rods 408, as concurrently presented in FIG. 3*a*. A movement of the piston 402 within the cylinder 404 is monitored and controlled based on measurements provided by a cable potentiometer 418 and a load cell 414.

A skilled person will recognize that other methods of monitoring and controlling the movement of the piston 402 within the cylinder 404 are possible such as using measurements provided by a Linear Variable Differential Transformer (LVDT), a rotary or a linear encoder, etc., without departing from the scope of the injection device 204.

Further presented in FIG. 4*a* according to one embodiment, the injection device 204 has a heating element 412 surrounding the cylinder 404 in order to maintain an adequate temperature within the cylinder 404 and maintain adequate rheological properties of the feedstock for preventing solidification of the feedstock inside the cylinder 404. Moreover, in order to provide a better control of the temperature within the cylinder 404, and also to maintain adequate rheological properties of the feedstock, an insulator 410 can additionally be required. The insulator 410 is adapted to surround the heating element 412 or the cylinder 404 in order to prevent heat dissipation from the mixture.

In an alternate embodiment, when the feedstock has slow solidification rate or when the mold injection process is sufficiently rapid, the cylinder 404 may not require a heating element to maintain adequate rheological properties of the feedstock and may only require the insulator 410, if necessary.

Figure 4B:
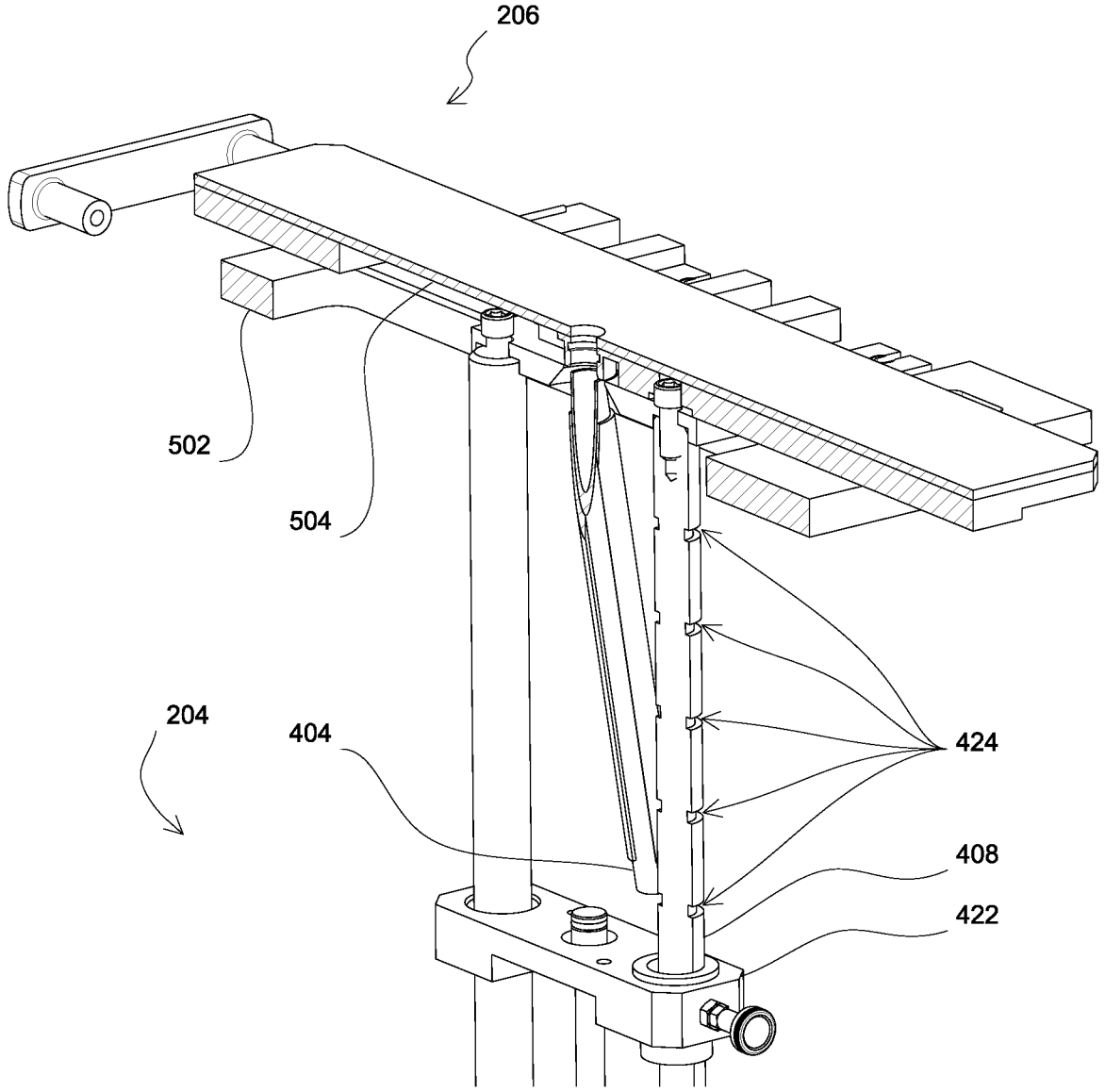
FIG. 4*b*, illustrates a partial section view of the injection device of FIG. 3*a*, with a removable injection cylinder, the injection device being configurable according to a length of the removable injection cylinder, according to one embodiment.

Presented in FIG. 4*b* according to one embodiment, is the table 206 with the injection device 204 attached thereto. The cylinder 404 of the injection device 204 is removeable. In one instance, the cylinder 404 is removeable to facilitate a cleaning thereof. In another instance, the injection cylinder 404 is removeable and interchangeable for selecting the cylinder 404 having an adapted dimension depending on a required amount of feedstock to be injected into the mold 214 or according to a volume of the mold 214. In this embodiment, a support 422 of the injection device 204 clips on notches 424 located on rod 408 for providing five levels of cylinder length adjustments.

Figure 5:
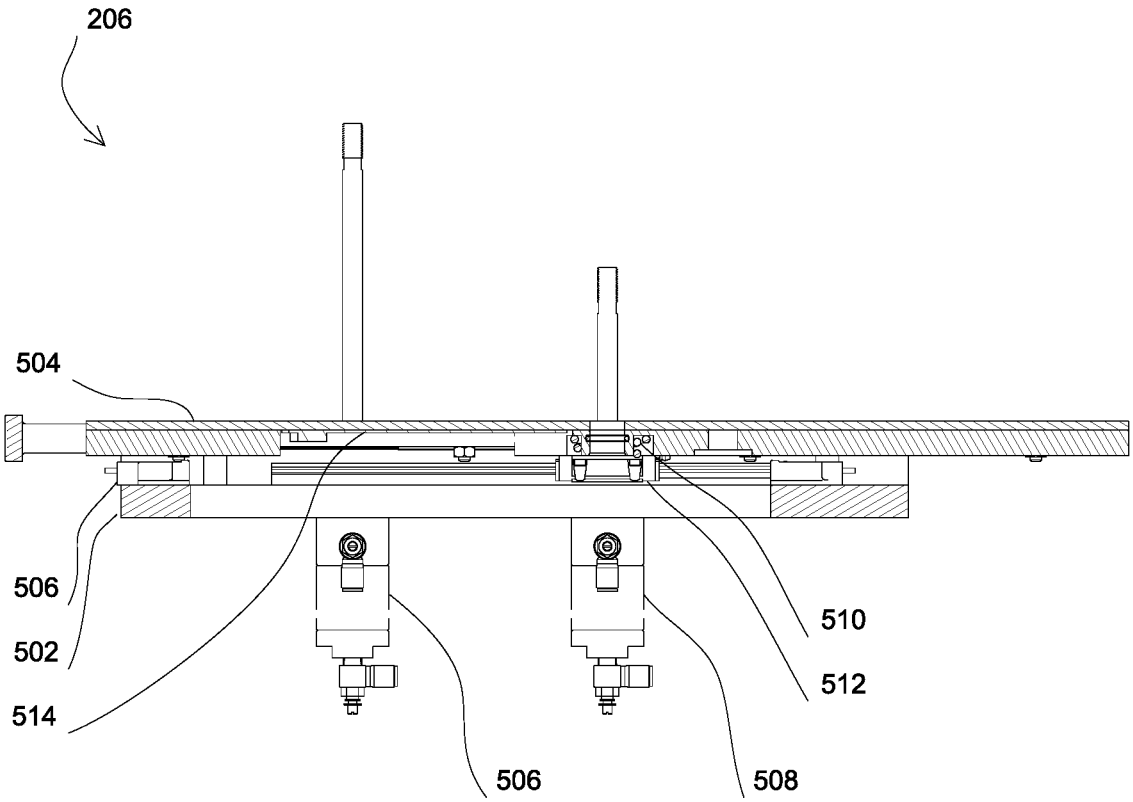
FIG. 5, illustrates a front sectional view of a table of the injection device of FIG. 3*a*, according to one embodiment.

FIG. 5 presents a detailed sectioned view of the table 206, according to one embodiment. The table 206 has a fixed platform 502 and a sliding platform 504, as concurrently presented in FIG. 4*b*. The sliding platform 504 is adapted to displaceably support the injection device 204 from a feedstock loading position that is aligned with the feedstock container 210 to a feedstock injection position that is aligned with an inlet of the mold 214. The fixed platform 502 is adapted to support a first pneumatic cylinder 506 that is for actuating the vertical displacement of the mixer 212, as concurrently presented in FIG. 3*a*. The fixed platform 502 is further adapted to support a second pneumatic cylinder 508 that is for actuating the vertical displacement of the mold holder 215, as concurrently presented in FIG. 3*a*. Note that other means for actuating either one of the mixer 212 displacement or the mold holder 215 displacement are possible, such as a manual displacement or a displacement provided by an electric cylinder without departing from the present injection system 102.

A skilled person will understand that the fixed platform 502 could be integral or at least part of the base structure 208 without departing from the present injection system 102.

Figure 6:
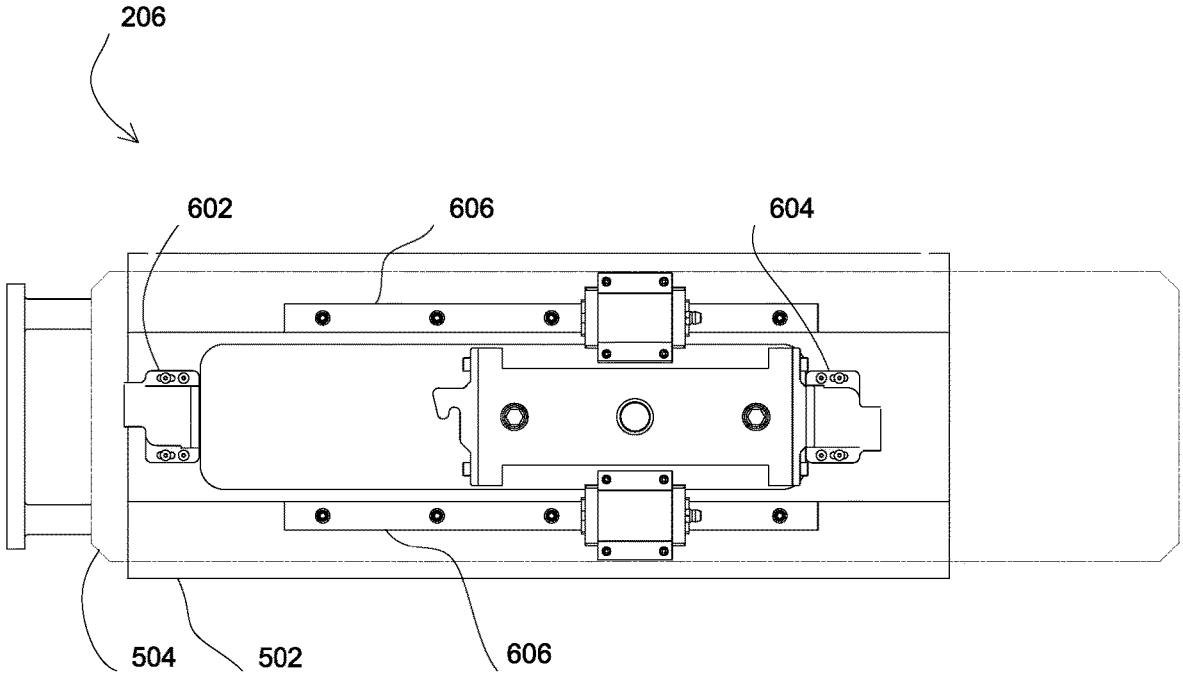
FIG. 6, illustrates a top view of the table of FIG. 5 where a sliding platform is represented by a center line for clarity, according to one embodiment.

From a top view of the table 206 as presented in FIG. 6, the fixed platform 502 further has two latches 602 and 604 for positioning the sliding platform 504—herein represented by a center line—in either a feedstock container alignment position via latch 602 or in a mold alignment position via latch 604. The fixed platform 502 further has rails 606 that are adapted to guide the sliding platform 504 movement with respect to the fixed platform 502.

Moreover, in case of feedstock residue leakage or buildup on the sliding platform 504, additional heat can be required for maintaining an adequate temperature at the sliding platform 504 to maintain the mixture residue in a molten state. This way cleaning or wiping off the mixture residue from the sliding platform 504 can be accomplished with ease. According to one embodiment and as presented in FIG. 5, the sliding platform 504 has a heated band 514 and a heated cable 510 for dissipating heat to the sliding platform 504 at a surface and also at a junction of the cylinder 404 with the sliding platform 504, respectively. A skilled person will recognize that any other means for heating the sliding platform 504 are possible without departing from the scope of the present table 206. It shall further be recognized that such additional heating may not be required if the ambient room conditions are suitable for maintaining a molten mixture.

Figure 7:
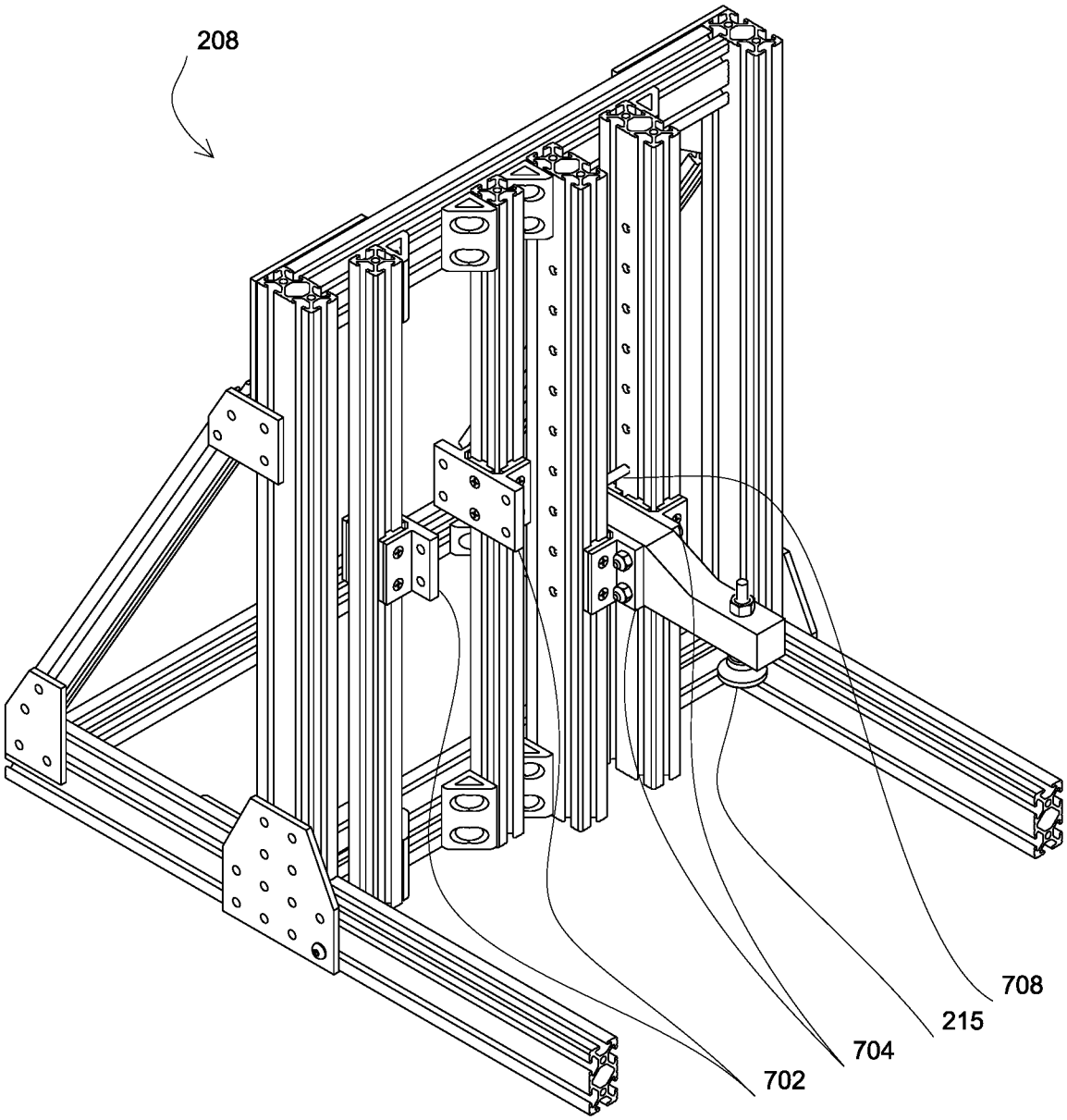
FIG. 7, illustrates a base structure of the injection device of FIG. 3*a*, according to one embodiment.

According to one embodiment and as presented in FIGS. 2 and 7, the base structure 208 is adapted for attaching the table 206 thereon. The table 206 is positioned such as to allow the first pneumatic cylinder 506 to align with a mixer displacement slider 702 and to allow the second pneumatic cylinder 508 to align with a mold displacement slider 704 in order to activate the sliders (702 and 704). Note, that some variations in the alignment of the displacement sliders (702 and 704) with the respective pneumatic cylinders (506 and 508) are possible depending on the configuration of the base structure 208. Moreover in this embodiment, the mixer displacement sliders 702 and 704 are double sliders that are adapted to slide along two vertical members of the base structure 208. However, any other type of suitable sliders (702 or 704) can be used with the base structure 208, without departing from the present injection system 102.

According to one embodiment and as further presented in FIG. 7, a mold holder 215 is mounted on the displacement slider 704. In operation, when the second pneumatic cylinder 508 activates the displacement slider 704, the mold holder 215 is displaced accordingly, thereby providing enough space for placing and removing the mold 214 from the sliding platform 504. According to one embodiment, a rod 708 is positioned on the base structure 208 in order to limit the displacement movement of the slider 704 and prevent the mold holder 215 from being displaced too far away from the table 206.

It shall be understood that any other suitable means of removeably immobilising or placing the mold 214 on the sliding platform 504 are possible without departing from the scope of the present injection system 102.

The base structure 208 presented in FIG. 7 is made from extruded aluminum however the base 208 can be made from any other suitable material that is strong enough to support the various components of the injection system 102 Moreover the base structure 208 can have any other suitable shape or configuration that is adapted for operatively supporting with adequate stability, be it in combination or individually, the various components of the injection system 102.

Figure 8:
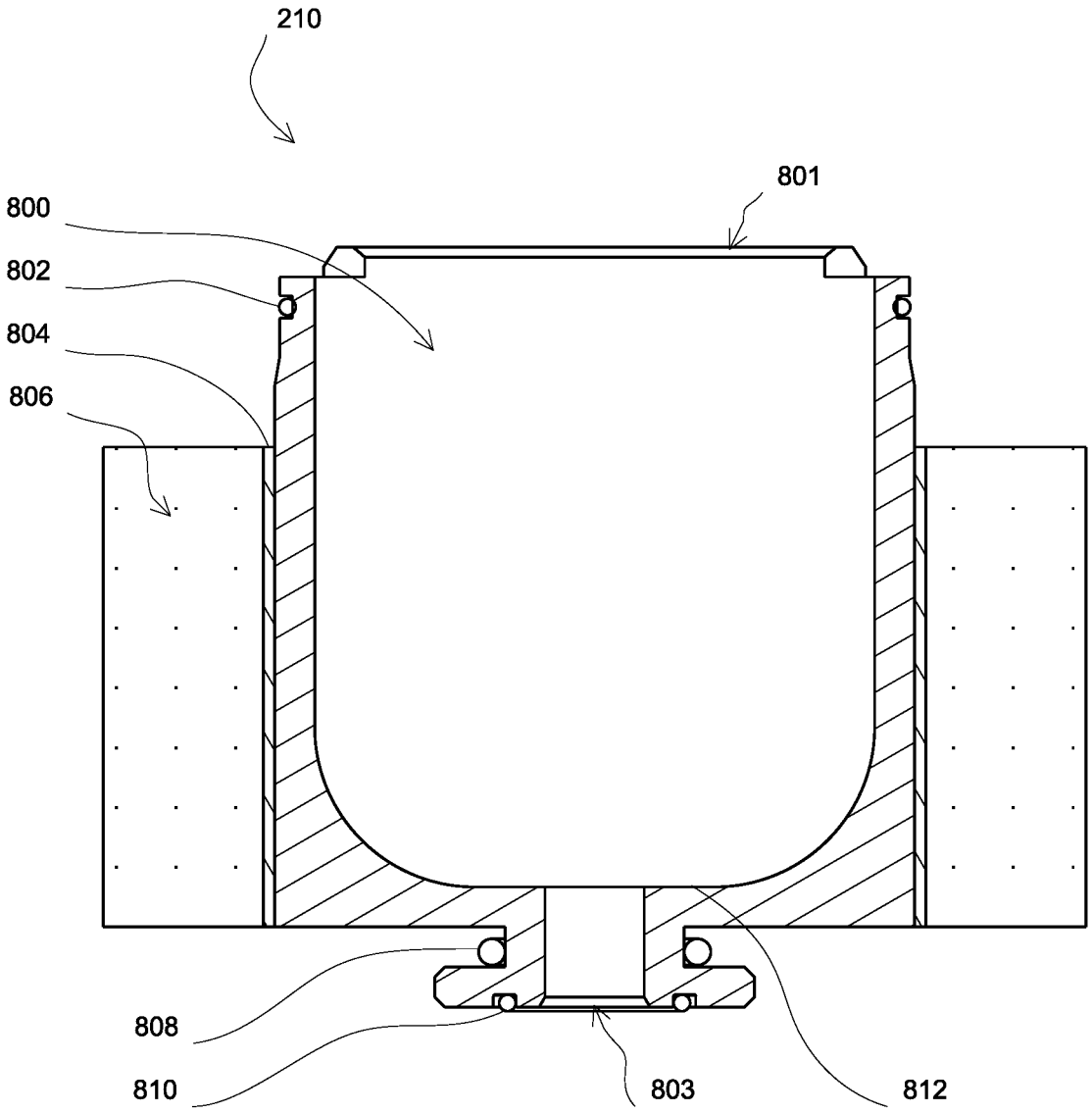
FIG. 8, illustrates a section view of a feedstock container of the injection device of FIG. 3*a*, according to one embodiment.

Presented in FIG. 8 is a sectional view of the container 210, according to one embodiment. As can be seen in FIG. 3*a*, the container 210 is removeably placed onto the sliding platform 504 of the table 206 and is immobilized by the engaged mixer 212. The container 210 has a chamber 800 that defines an inlet 801 and an outlet 803. The inlet 801 is adapted for inserting the various powder and binder elements required for creating a desired feedstock. Also the inlet 801 is adapted for introducing a mixing tool of the mixer 212 into the chamber 800. The outlet 803 is adapted for allowing passage of the feedstock from the container 210 to the cylinder 404 and vice versa. Moreover, the outlet 803 is also adapted for allowing passage of the piston 402 up to an internal wall 812 of the chamber 800. The container 210 also has joints (802 and 810) respectively positioned near the inlet 801 and outlet 803 in order to prevent air infiltration into the chamber 800. According to an alternate embodiment, the joints (802 and 810) prevent unwanted feedstock leakage from the chamber 800.

For certainty, it shall be understood that the feedstock is produced from the mixing of feedstock ingredients within the chamber 800 or with any other mixing system. Any reference to the term "feedstock" shall be interpreted as any mixture of ingredients having the suitable properties for being injected into the mold and form a desired part and shall also be interpreted as being ingredients that are yet to be mixed or further mixed in order to produce a suitable mixture for injecting into the mold.

Moreover, as further presented in FIG. 8, the container 210 has heating elements (804 and 808) strategically positioned to provide heat to the chamber 800 and also to the outlet 803. Heat provided to the chamber 800 and to the outlet 803 prevents the solidification of the feedstock within the chamber 800 and the outlet 803. A skilled person will understand that depending on the feedstock composition, heating elements (804 or 808) may not be required if the setting time of the feedstock is prolonged or if the injection system 102 is adapted to produce molded parts rapidly enough and prevent the feedstock from solidifying within the chamber 800 or outlet 803.

Also according to one embodiment, the container 210 has an insulation material 806 adapted to surround the chamber 800 for preventing heat dissipation from the chamber and maintaining a suitable feedstock fluidity or viscosity.

In an alternate embodiment (not shown), the container 210 has an additional insulation material adapted to surround the outlet 803 for preventing, at least in part, heat dissipation from the outlet and maintaining a suitable feedstock fluidity or viscosity.

A skilled person will recognize that the container 210 can have any suitable dimension, shape or form and the location and number of heating elements such as heating elements 804 and 808 can differs from one embodiment to another. Moreover the skilled person will recognize that the location or number of any suitable insulation materials or combination thereof for, at least in part, preventing heat dissipation from the chamber 800 can differ from one embodiment to another. It shall further be recognized that such additional heating or insulation may not be required if, for instance, the ambient conditions are suitable for maintaining the feedstock in molten state.

Figure 9A:
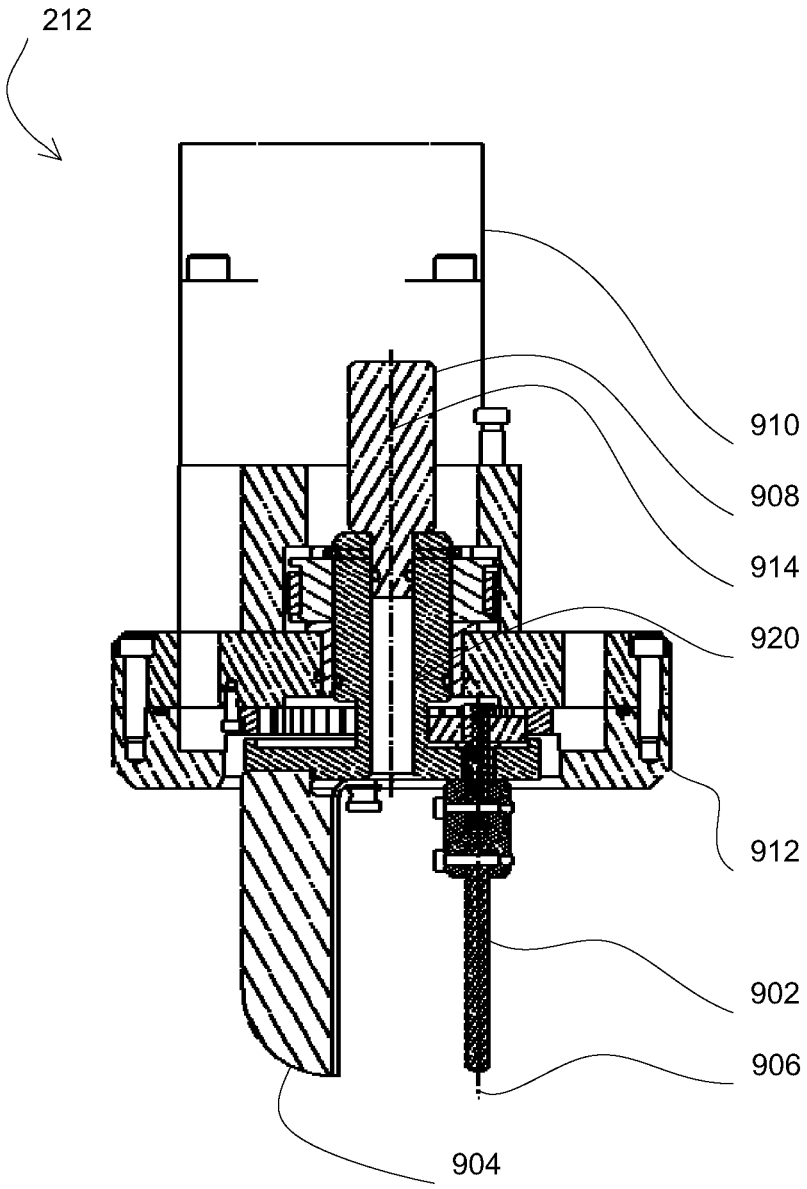
FIG. 9*a*, illustrates a front sectional view of a mixer of the injection device of FIG. 3*a*, according to one embodiment.
Figure 9B:
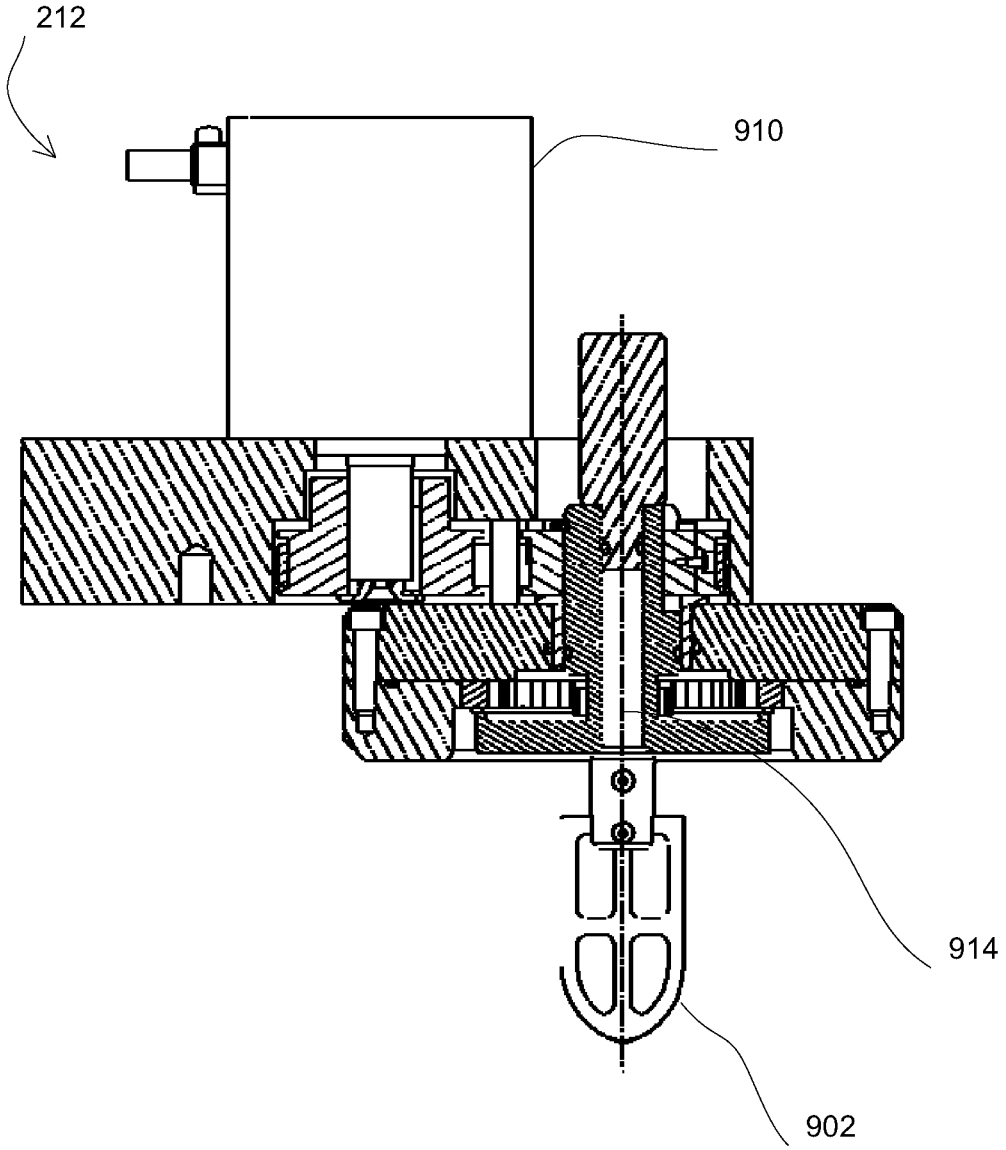
FIG. 9*b*, illustrates a side sectional view of a mixer of the injection device of FIG. 3*a*, according to one embodiment.

Presented in FIG. 9*a* is a front sectional view of the mixer 212 and presented in FIG. 9*b* is a side sectional view of the mixer 212, according to one embodiment. The mixer 212 is a planetary mixer, the mixer 212 has a removeable mixing tool 902 for engaging the container 210 and is adapted to mix a content thereof with a rotating motion around a mixing tool axis 906 and also around a common axis 914. As can be noticed, the mixing tool axis 906 is decentralized with respect to the common axis 914. Moreover, a removeable scrapper tool 904 is adapted to rotate around the common axis 914, as well. The scrapper tool 904 is adapted to scrappingly contact or at least sweep in proximity, at least in part, the interior wall 812 of the container 210 in order to prevent feedstock from settling onto the interior wall 812, as concurrently presented in FIG. 8. In this embodiment, the mixing tool 902 and the scrapper tool 904 are rotatably activated around the mixing tool axis 906 and the common axis 914 by a single motor 910, such as a brushless motor.

A skilled person will however understand that the mixing and scrapping tools (902 and 904) could be independently activated by dedicated motors, without departing from the scope of the present mixer 212. Moreover, depending of the feedstock to be mixed or the shape of the chamber 800, the scrapping tool may not be required and only the mixing tool 902 may suffice. Also, the mixing tool 902 may have a shape adapted to provide a dual function: a mixing function and a scrapping function, in this case the scrapping tool may not be necessary. For certainty, it shall be recognized that the mixing tool 902 or the scrapping tool 904 can be replaced by any other suitable tool or plurality of tools.

A skilled person will further understand that the planetary mixer 212 can be replaced altogether by any other suitable type of mixer for mixing the content of the container 210 without departing from the scope of the present machine 100.

According to one embodiment, as presented in FIGS. 2, 9*a* and 9*b*, the motor 910 is decentralized with respect to the common axis 914 in order to provide space for an inspection shaft 920 that is aligned with a center portion of the feedstock container 210 and consequently also aligned with the common axis 914. The inspection shaft 914 is adapted for inserting a camera, a probe, a microphone or any other suitable inspection tool that might be useful for monitoring, inspecting or even sampling the content of the mixing chamber 210. Since the mixing chamber 210 is maintained under vacuum to prevent the formation or air bubbles within the feedstock, a cap 908 is adapted to plug the inspection shaft 920 in order to prevent as much as possible air from entering into the mixing chamber 210 or hermetically seal the inspection shaft 920. A skilled person, will understand that the cap 908 can further be adapted to prevent dust or debris from entering the mixing chamber 210.

In an alternate embodiment, the inspection shaft 920 defines a sealed opening for positioning a desired inspection device into the chamber 800. The sealed opening being adapted to suitably prevent air from entering into the chamber 800 or hermetically seal the inspection shaft 920.

Figure 10:
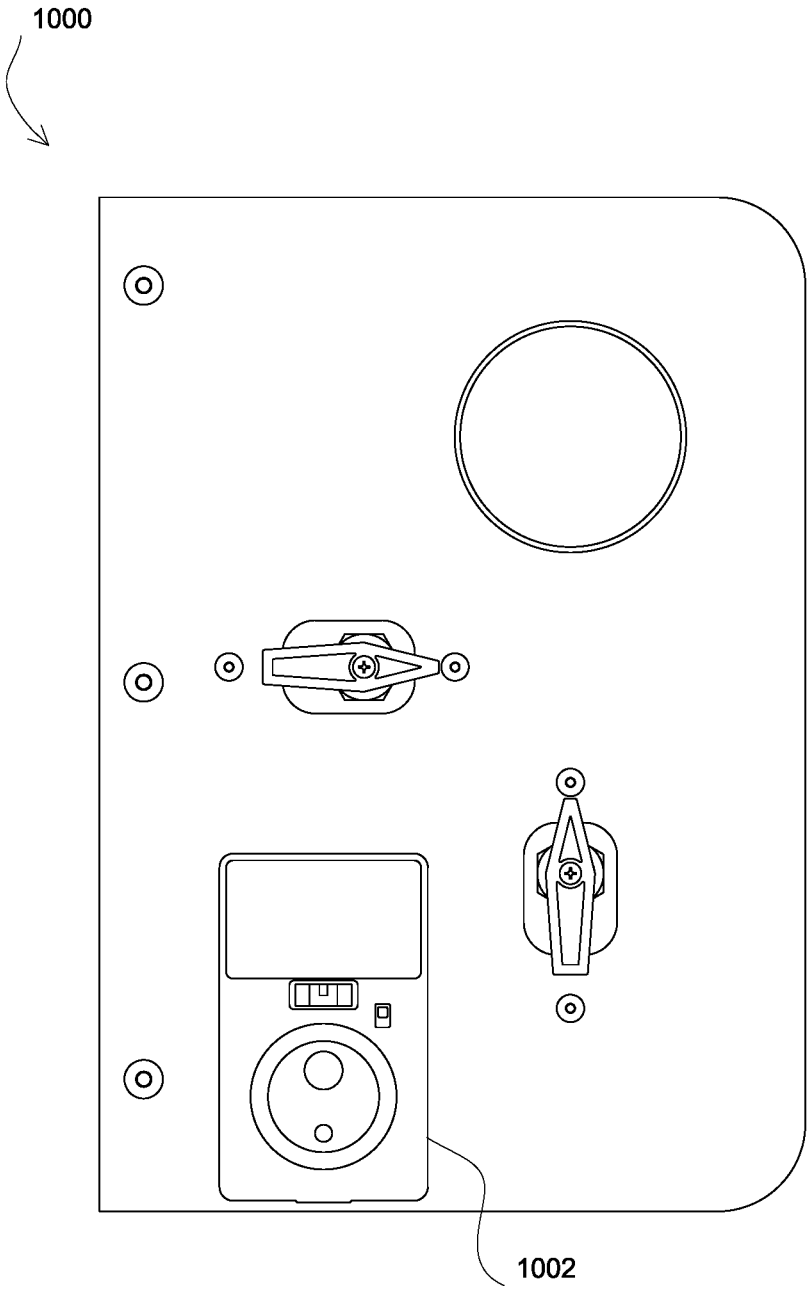
FIG. 10, illustrates a controller for controlling a motor of the mixer of FIGS. 9*a* and 9*b*, according to one embodiment.

As presented in FIGS. 2 and 10, a command panel 1000 has a controller 1002 for adjusting the direction and speed of the motor 910. According to one embodiment, the controller 1002 is user operated. In an alternate embodiment, the controller 1002 is preprogrammed or is connected to a programming module and is adapted to execute instructions according to a user defined program. In FIG. 3*a*, the command panel 1000 is attached to the injection system 102. However, it shall be understood that the command panel 100 can be located in any suitable location for controlling the motor 910 and that the command panel 1000 can have any suitable shape or form. For example, the command panel 1000 can be replaced by a software command module that is adapted to send instructions to a command interface of the motor 910.

Figure 11:
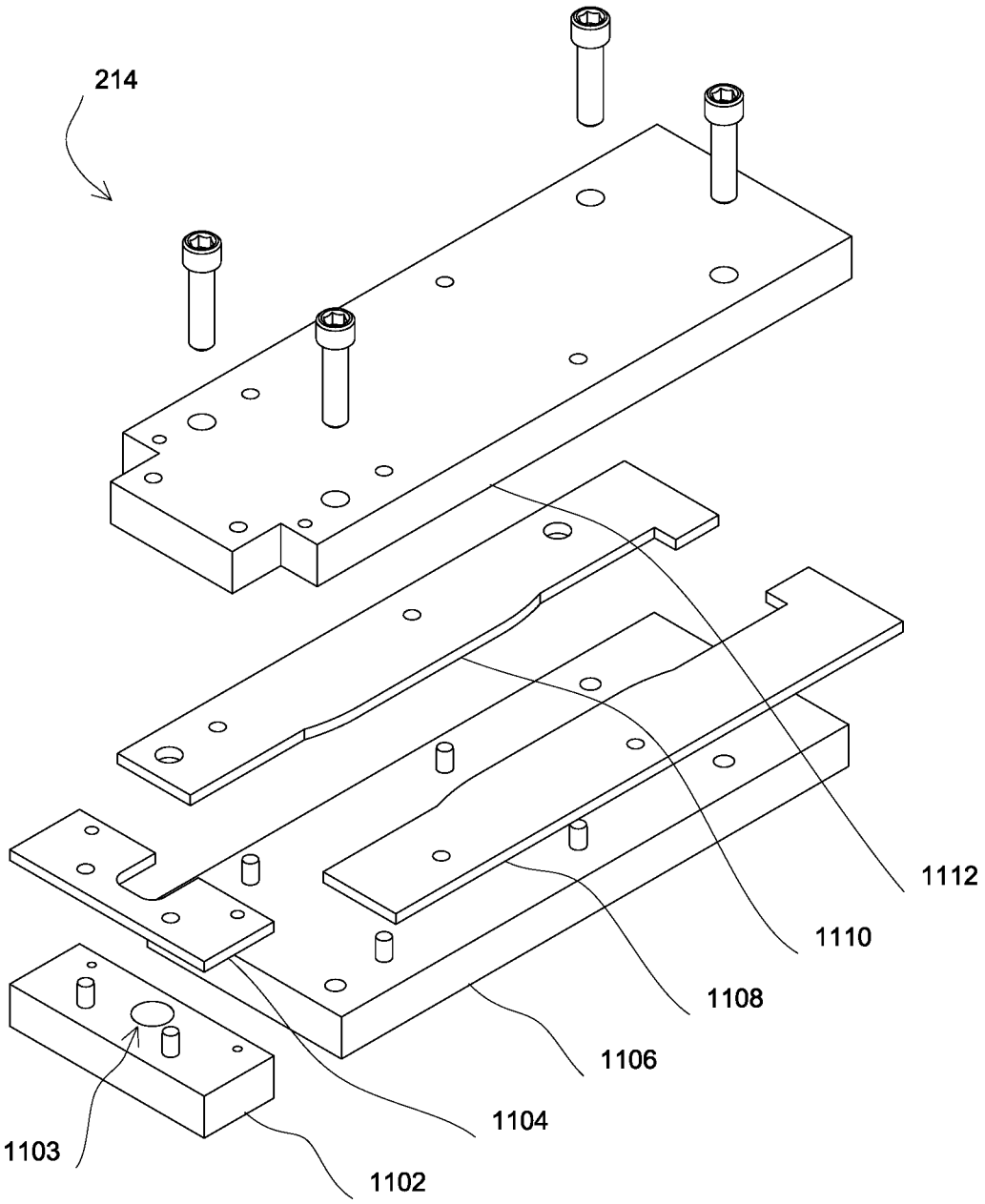
FIG. 11, illustrates an exploded view of a mold of the injection device of FIG. 3*a*, according to one embodiment.

Presented in FIG. 11, is an exploded view of an embodiment of the mold 214. In this embodiment, the mold parts are detachably connected with screws in order to easily remove a resulting molded piece therefrom. The mold 214 has an entry part 1102 defining an injection inlet 1103 configured to receive the feedstock from the injection device 204. The mold 214 further has base plates 1106 and 1112 to which are attached interchangeable form plates such as form plates 1104, 1108 and 1110 that define a cavity according to a desired part shape to be molded. Notice that the cavity defined by the base plates and form plates are in communication with the injection inlet 1103 to allow free passage of the feedstock from the injection inlet 1103 to the cavity.

The illustrated mold 214 embodiment of FIG. 11 is formed with plates adapted to produce a desired molded shape when attached with screws. However, a skilled person will recognize that the mold 214 can have any other suitable form or configuration and that the mold plates or the mold screws can be replaced by any other suitable type of plates or attachment that are adapted to define a cavity for producing a desired shape. Moreover, it shall further be recognized that the mold 214 can be made from a single piece without requiring plates or attachment screws.

Figure 12:
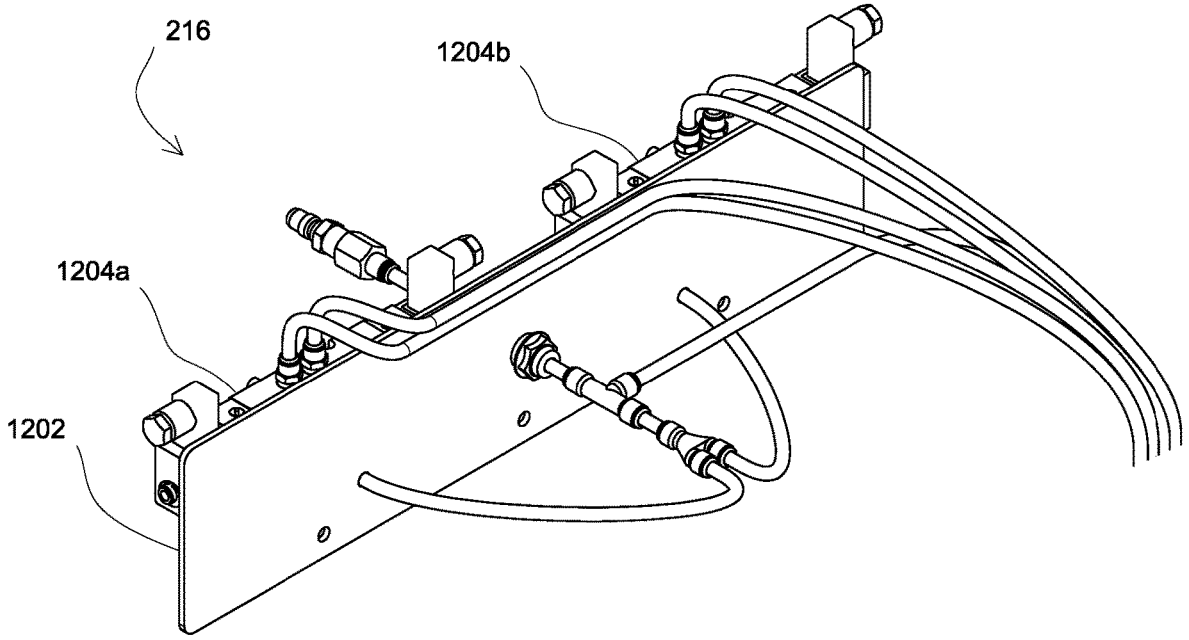
FIG. 12, illustrates a pneumatic system for feeding pneumatic cylinders of the table of FIG. 5 according to one embodiment.

Presented in FIG. 12 is the pneumatic system 216 according to one embodiment and as concurrently presented in FIG. 3*a*. The pneumatic system 216 has a mounting plate 1202 that is attachable to the base structure 208 of the injection system 102, as shown in FIG. 3*a*. Attached to the mounting plate are pneumatic valves 1204*a* and 1204*b* respectively adapted to control the first and second pneumatic cylinders 506 and 508 of FIG. 5 for actuating the mixer displacement and the mold holder displacement.

A skilled person will understand that the mounting plate 1202 can be replaced by any other suitable means of providing the various valves for activating the pneumatic cylinders 506 and 508. In this embodiment, the valves 1204*a*, 1204*b* are controlled by a computer according to a predefined program, however it shall be understood that those valves could also be at least in part user operated or controlled by a computer according to a user input.

Figure 13:
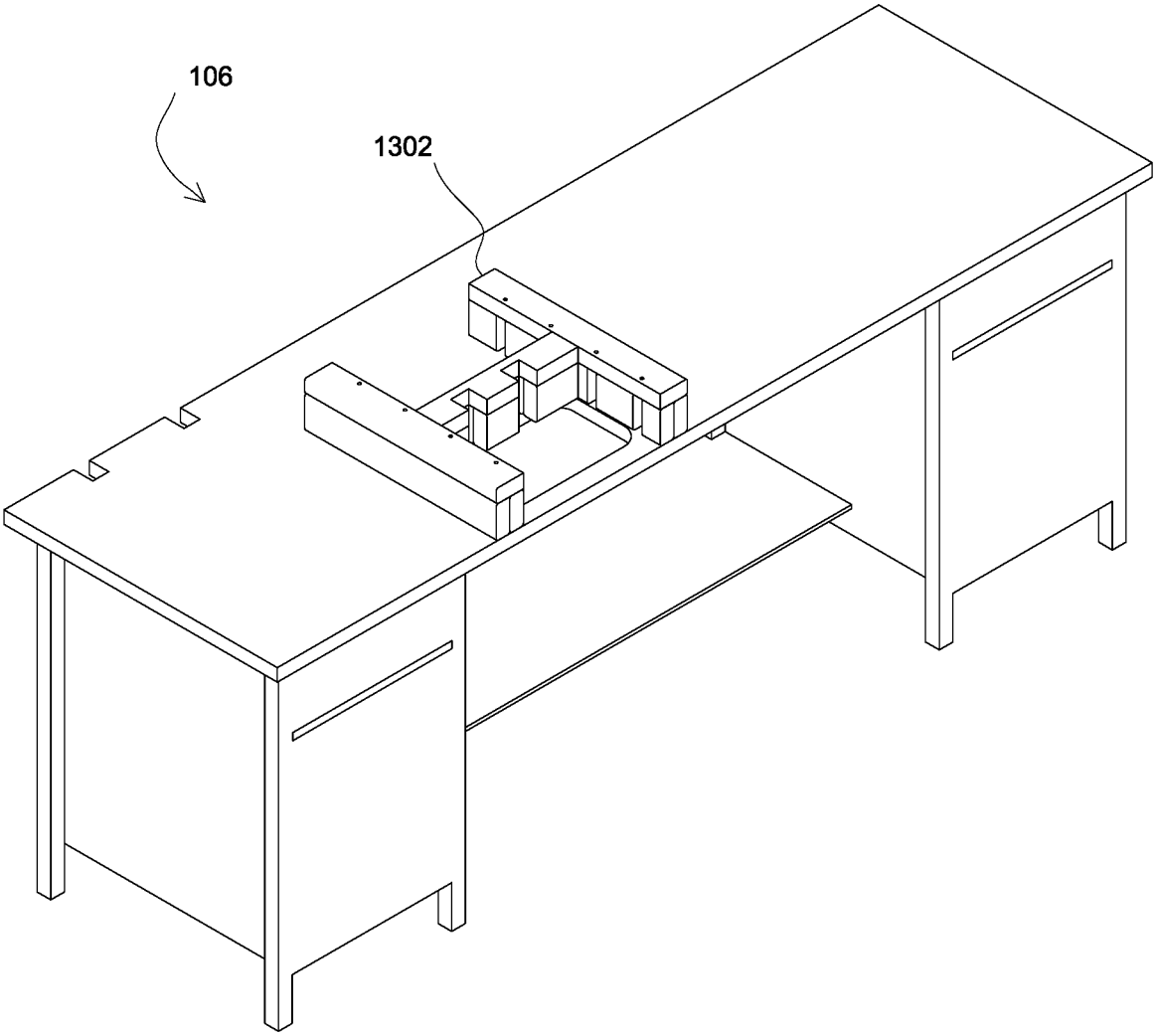
FIG. 13, illustrates a support table adapted to operatively support the injection device of FIG. 3*a*, according to one embodiment.

Presented in FIG. 13 according to one embodiment, the support table 106, as concurrently presented in FIG. 3*a* has an elevation member 1302 adapted to elevate the injection system 102 off from the ground. Notice that if the support table 106 is high enough or if the injection system 102 is short enough, the elevation member 1302 may not be required.

Figure 14:
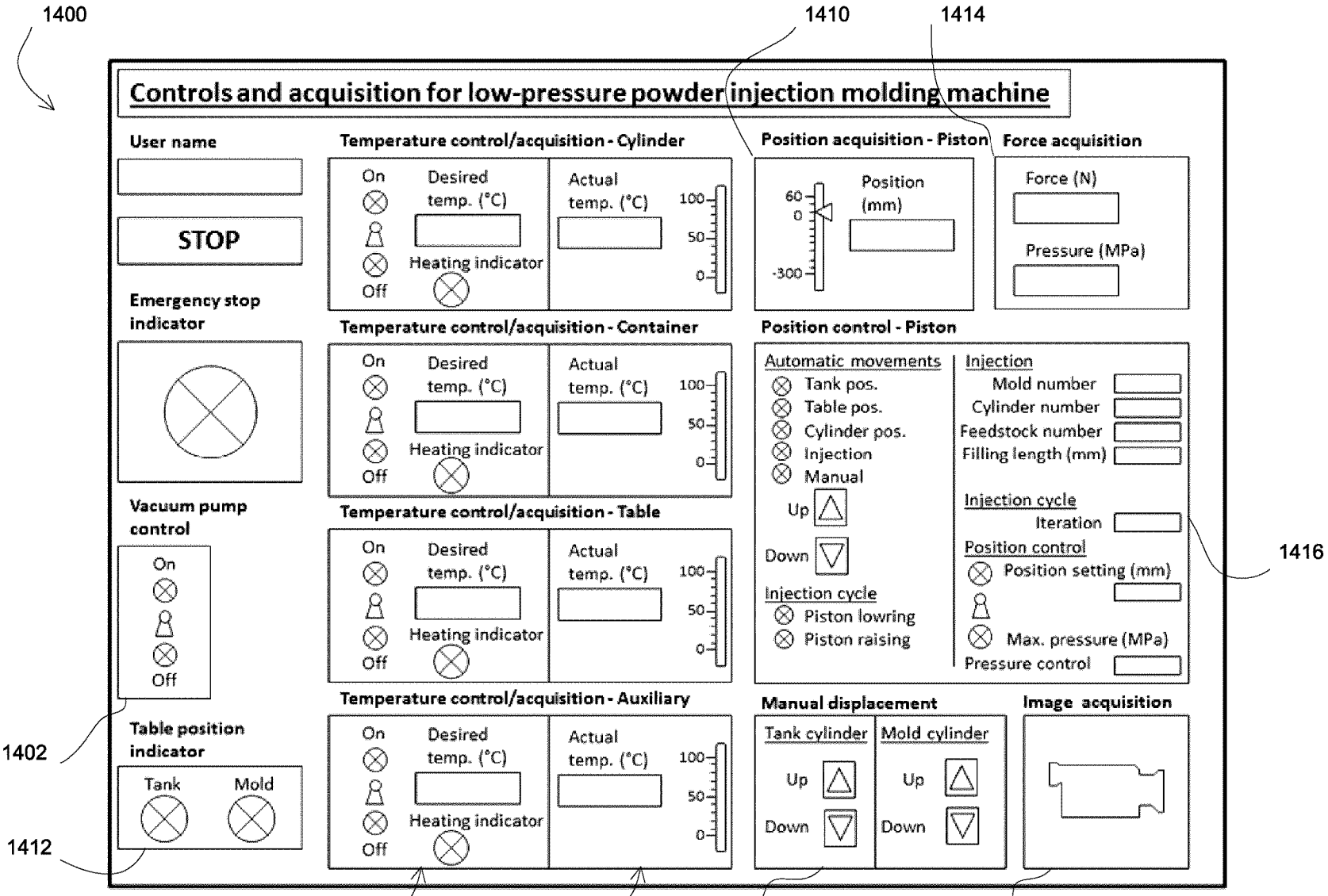
FIG. 14, illustrates a snapshot of a user interface displayed by a monitor of the low-pressure molding machine of FIG. 2, the user interface being adapted to allow an operator to monitor and input control commands for controlling the injection device of FIG. 3*a*, according to one embodiment.

According to another aspect, presented in FIG. 14 is a user interface 1400 provided by the monitor 108, according to one embodiment. The user interface 1400, allows a user to control the various components of the injection system 102 and also to monitor the various states of the injection system 102. For example, according to one embodiment, the user interface 1400 has a vacuum pump control switch 1402 adapted to allow a user to activate and deactivate the vacuum system 202 of the injection system 102. The user interface 1400 has temperature setting fields 1404*a* each adapted to set a heating temperature of an associated component of the injection system 102 such as for setting the temperature of the cylinder 404, the container 210, the table 206 or an auxiliary thermocouple socket for cleaning purposes. The auxiliary thermocouple socket can be used by the container 210 or the cylinder 404 when unmounted or by a replacement container or a replacement cylinder when cleaning of such components is required without interrupting an injection cycle. Moreover, the user interface 1400 has temperature monitoring windows 1404*b* each adapted to present to the operator a temperature reading of an associated component of the injection system 102 such as a temperature reading of the cylinder 404, the container 210, the table 206 or the auxiliary thermocouple socket for cleaning purposes. Moreover the user interface 1400 has a table position indicator 1412 such as to indicate to the operator if the table is aligned with the feedstock container or if the table is aligned with the mold.

Also the user interface 1400 has a cylinder position controlling interface 1406 for an operator to control a position of the first pneumatic cylinder 506 and a position of the second pneumatic cylinder 508. The user interface 1400 further has a piston position controlling interface 1416 and a piston position monitoring interface 1410 for an operator to control and monitor a position of the piston 402 within cylinder 404. In addition, the user interface 1400 has a pressure indicator 1414 for indicating to the operator a pressure or force applied by the piston 402 within the cylinder 404 during injection into the mold.

When a camera is used as an inspection tool to monitor the content of the feedstock container 210, the user interface 1400 has a display region 1408 for presenting to the operator an image acquired by the camera.

A skilled person will understand that the user interface 1400 can be presented differently to the operator and yet provide similar information for monitoring and controlling the various components of the injection system 102. Moreover additional monitoring and controlling information can be provided via the interface 1400 such as a mixing speed of the mixer 212 or any other information that can be considered beneficial for producing a molded part with accuracy.

Figure 15A:
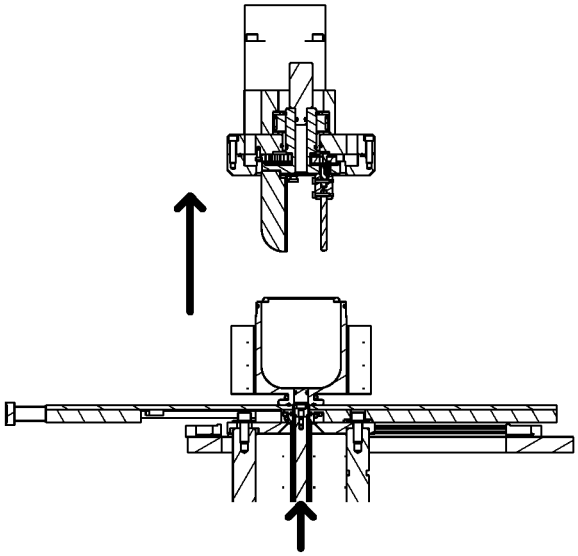
FIG. 15*a* to FIG. 15*h*, illustrates a partial section view of the injection device of FIG. 3*a*, with the mixer of FIGS. 9*a* and 9*b*, a piston of the injection cylinder of FIG. 4*a* and the mold of FIG. 11 in various operative positions.
Figure 15B:
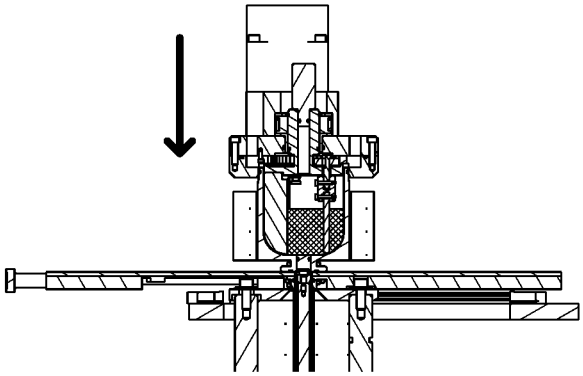
Figure 15C:
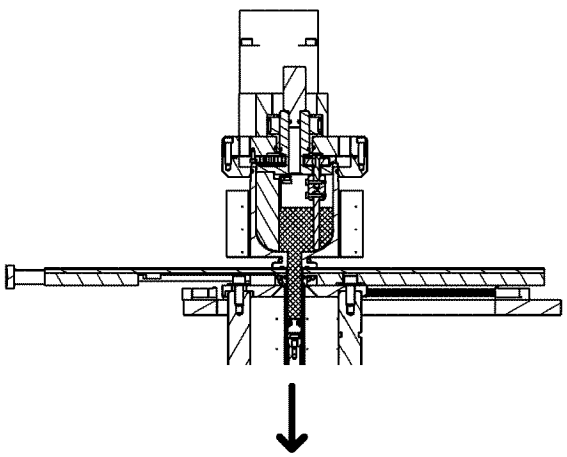
Figure 15D:
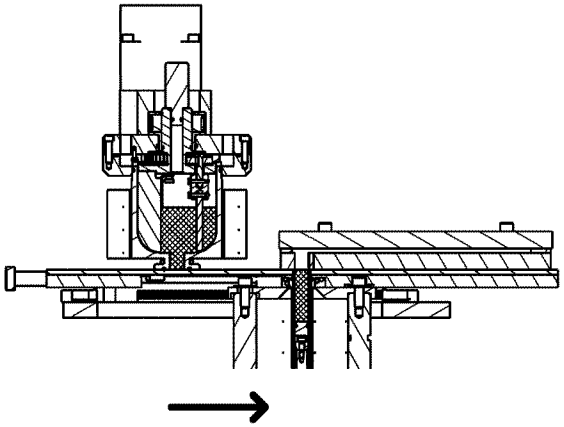
Figure 15E:
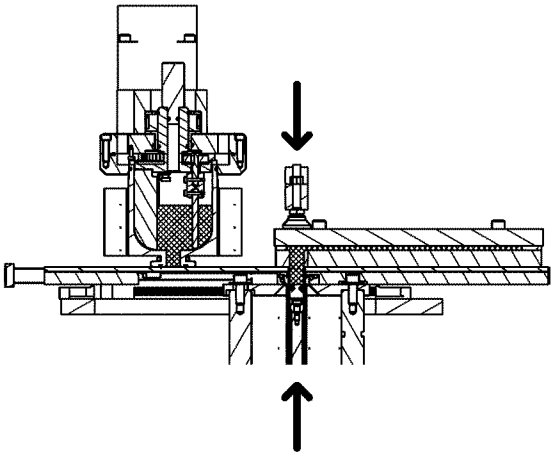
Figure 15F:
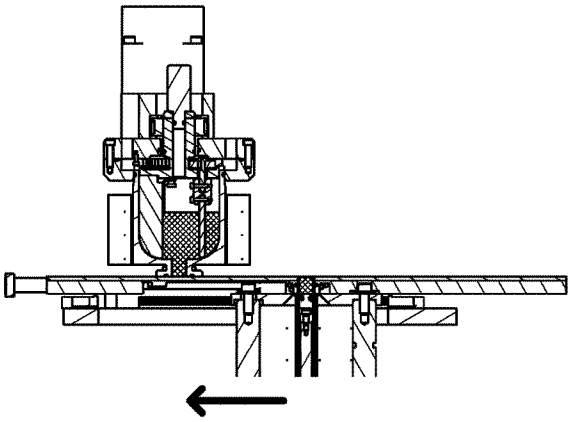
Figure 15G:
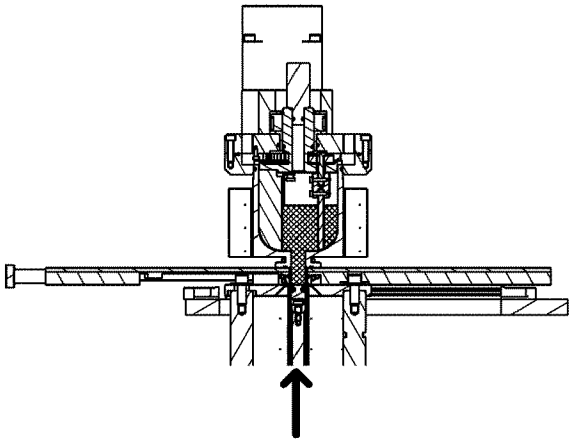
Figure 15H:
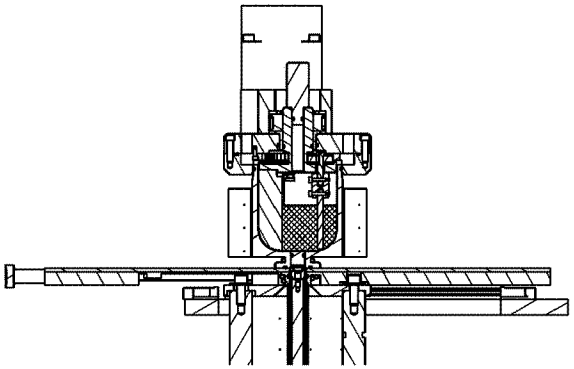
Figure 16:
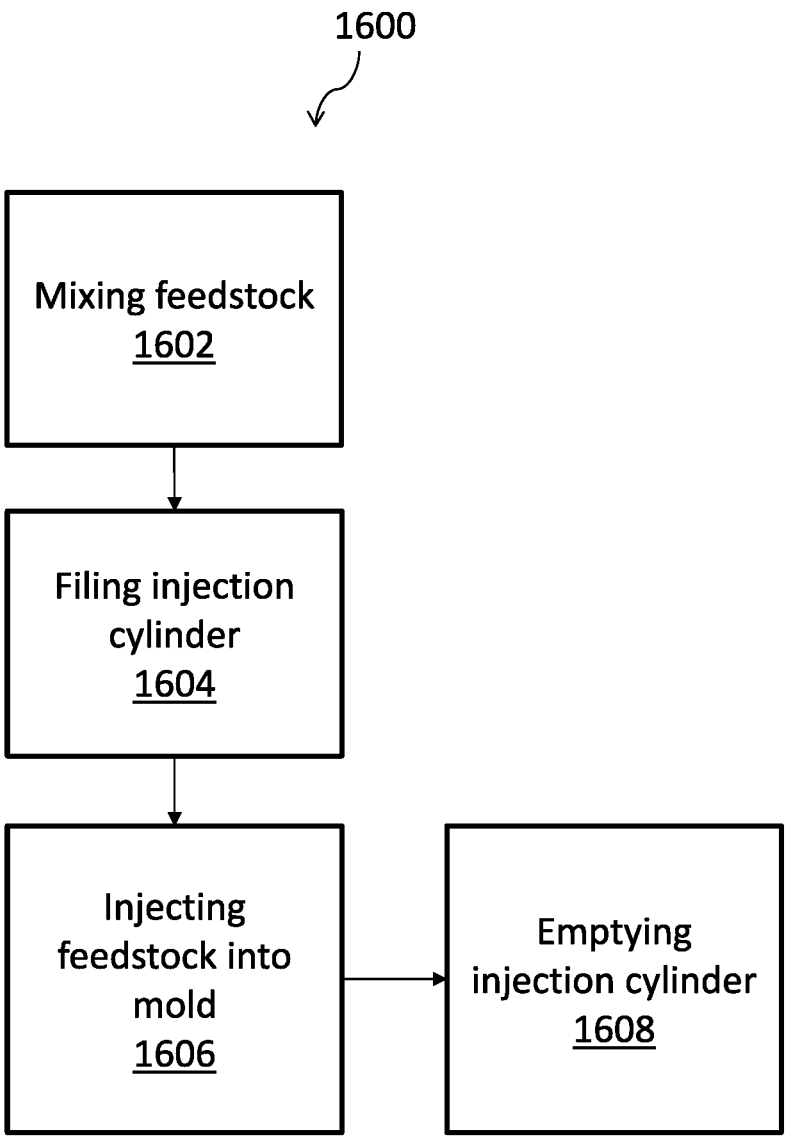
FIG. 16, illustrates a block diagram describing a method for producing a molded piece, according to one embodiment.

In order to better understand the operations of the injection system 102, FIGS. 15*a* to 15*h* visually present the various states of the injection system 102 according to a method for producing a molded part 1600, as concurrently presented in FIG. 16. The method 1600 requires mixing a feedstock 1602, filing an injection cylinder 1604 and injecting feedstock into a mold 1606. Once filed 1604, the complete content of the injection cylinder is fully injected into the mold 1606 or if not fully injected into the mold 1606, the remaining content of the injection cylinder is returned and emptied 1608 into the container for further mixing. This way, there is no residual mixture or feedstock that remains idle within the injection cylinder and thereby contamination or segregation of feedstock between injection cycles is avoided.

Figure 17:
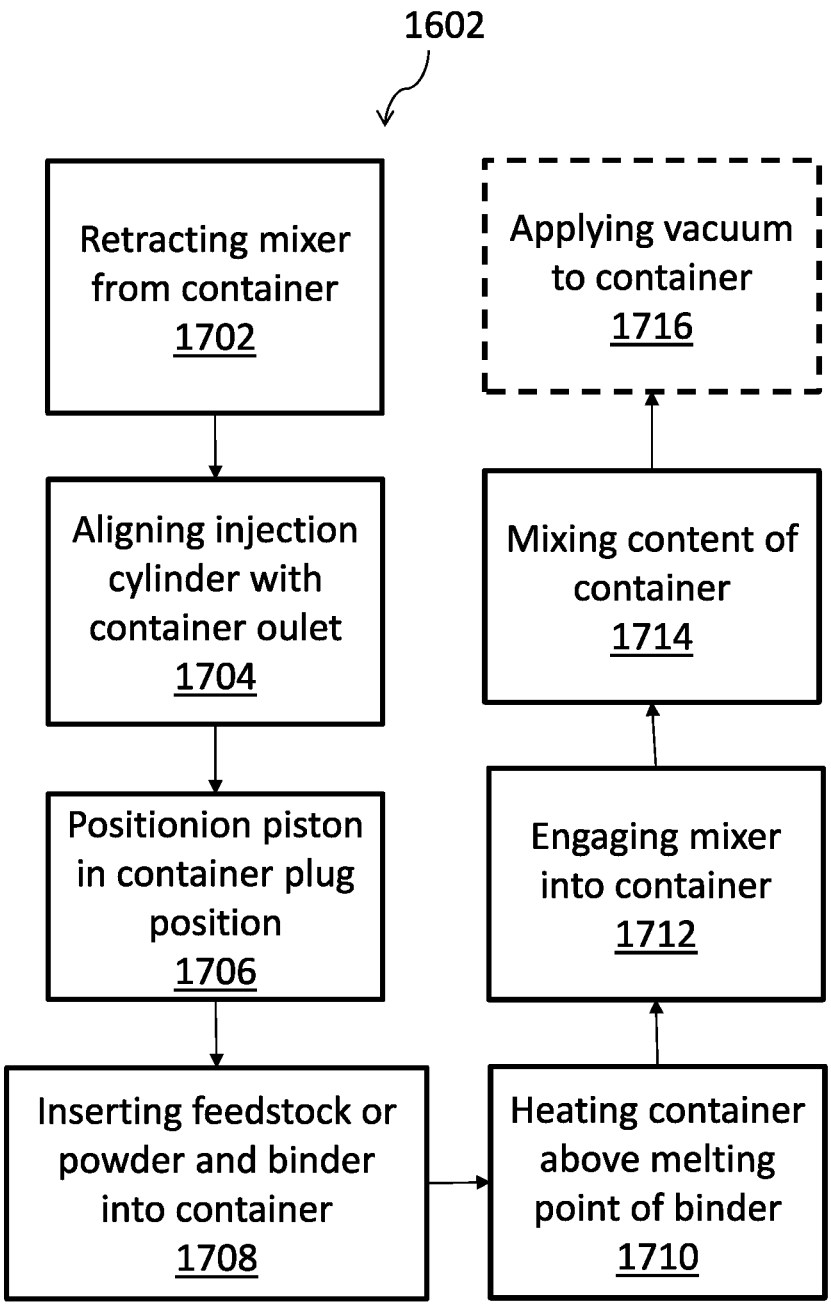
FIG. 17, illustrates a block diagram describing a method of mixing a feedstock for producing a molded piece, according to one embodiment.

In more detail, FIG. 17 presents according to one embodiment, the method of mixing a feedstock 1602. The method 1602 consists of retracting the mixer 1702 away from the container in order to provide enough space for inserting the feedstock or the feedstock ingredients (i.e. powder and binder) into the container, aligning the injection cylinder with the container outlet 1704 and positioning the piston of the injection cylinder in order to plug the container outlet 1706, as concurrently presented in FIG. 15*a*. Once the container is accessible and plugged at its outlet, feedstock or the feedstock ingredients are inserted into the container 1708, heat is then applied to the container at least up to or above a melting point of the binder 1710 and the mixer is then engaged into the container 1712 for mixing the content of the container 1714, as concurrently presented in FIG. 15*b*. During the mixing 1714, a vacuum is applied to the container 1716, at least for a certain period in order to remove excess air from the container and prevent air bubble formation within the feedstock.

It shall be recognized that in the method of mixing a feedstock 1602, various steps can take place simultaneously without departing from the scope of the method 1602. For instance, the retracting mixer 1702, the aligning injection cylinder 1704 and the positioning piston in container plug position 1706 can take place simultaneously. Also, the heating container 1710, the mixing content 1714 and the applying vacuum 1716 can take place simultaneously.

Figure 18:
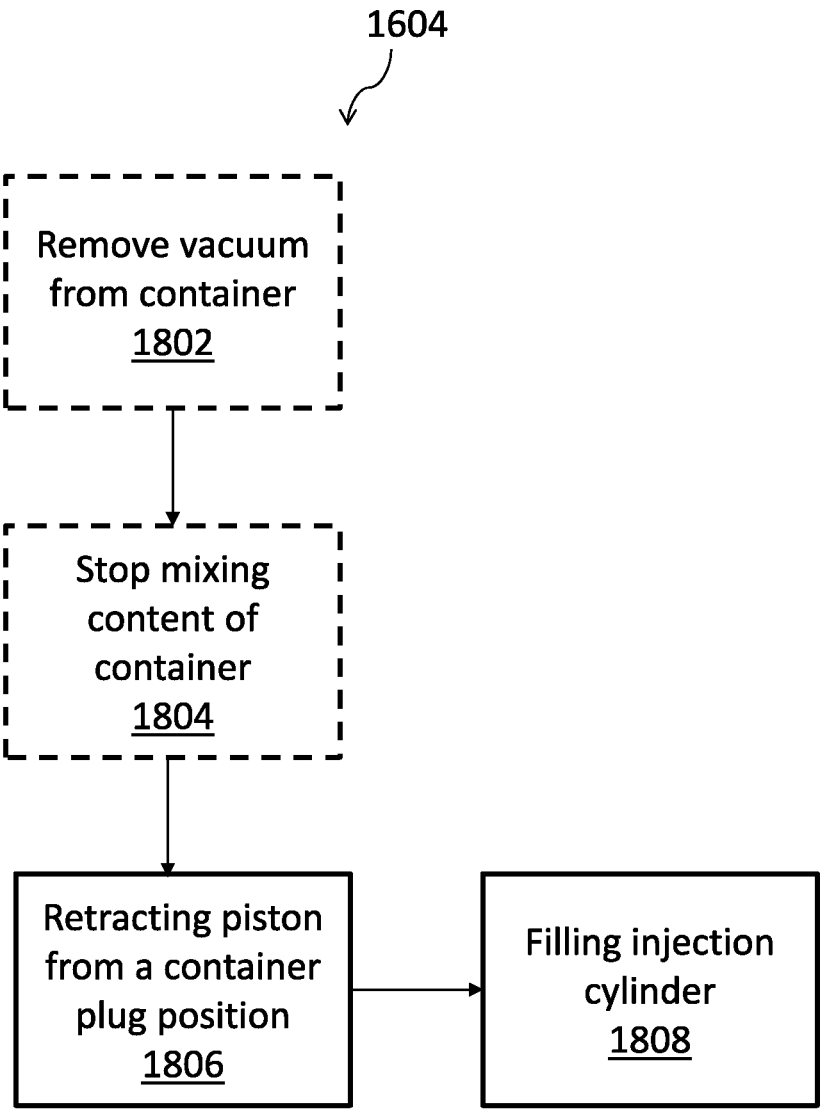
FIG. 18, illustrates a block diagram describing a method of filing an injection cylinder for producing a molded piece, according to one embodiment.

FIG. 18 presents according to one embodiment, the method of filling the injection cylinder 1604. The method 1604 consists of first removing the vacuum from the container 1802 and stopping the mixing of the content of the container 1804 before retracting the piston from the container plug position 1806 in order to fill the injection cylinder 1808 with some feedstock up to a desired or predetermined level, as concurrently presented in FIG. 15*c*. The vacuum is removed from the container 1802 before filling the injection cylinder 1808 to allow filling of the injection cylinder with greater ease since the injection cylinder is filled with a suction force that is applied by a displacement or retraction of the piston within the injection cylinder away from the container outlet, in this case, a lowering of the piston within the injection cylinder 1806.

It shall be recognized that in the method of filling the injection cylinder 1604, various steps can take place simultaneously without departing from the scope of the method 1604. For instance, the removing vacuum 1802 and the stopping mixing 1804 can take place simultaneously. Also, the retracting piston 1806 and filling injection cylinder 1808 can take place simultaneously.

Figure 19:
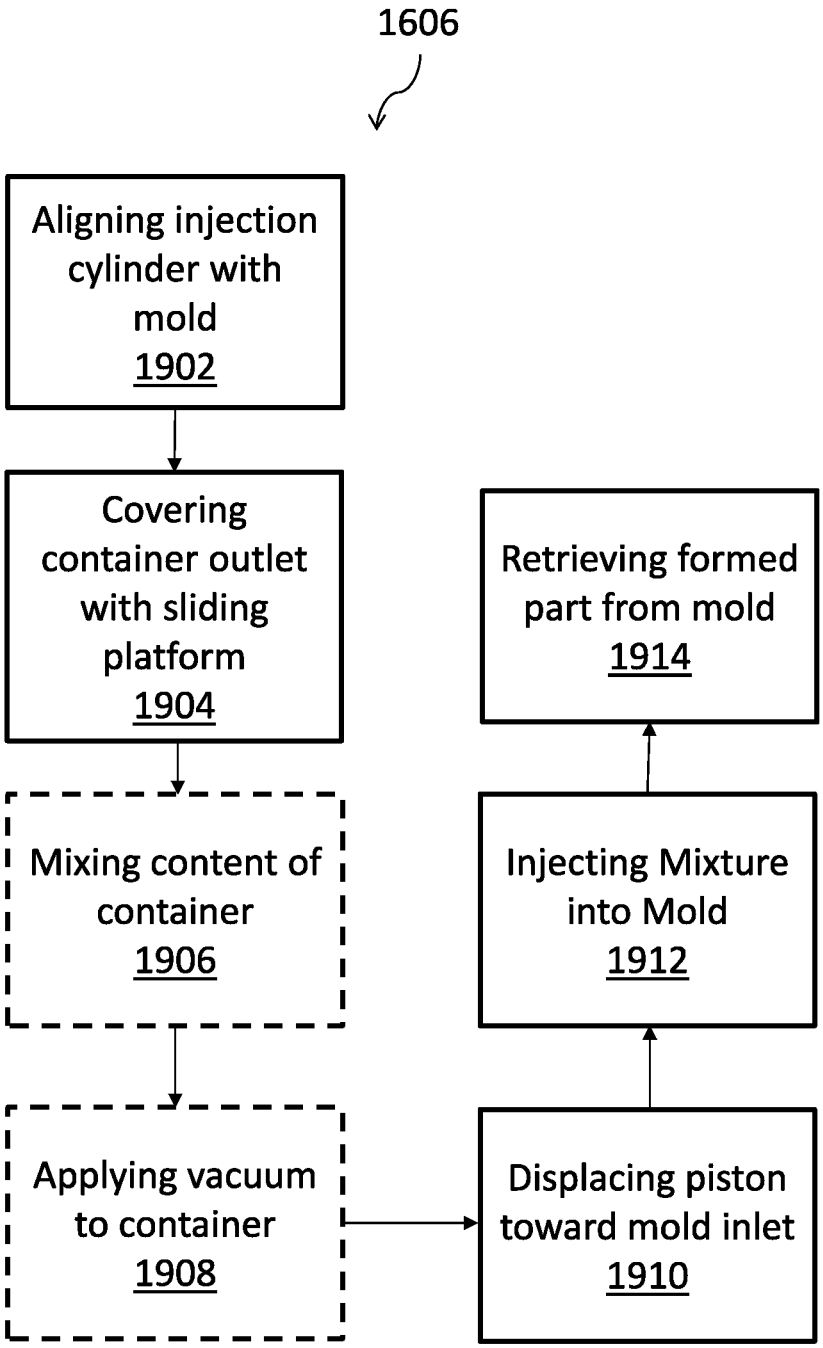
FIG. 19, illustrates a block diagram describing a method of injecting a feedstock into a mold for producing a molded piece, according to one embodiment.

FIG. 19 presents according to one embodiment, the method of injecting the feedstock into a mold 1606. The method 1606 consists of aligning the injection cylinder with an inlet of the mold 1902 by displacing the injection cylinder from a container alignment position to a mold alignment position as concurrently presented in FIGS. 15*c*, 15*d* and 15*e*. During the aligning with an inlet of the mold 1902 and as the injection cylinder is displaced away from the container alignment position, as illustrated in FIG. 15*e*, the sliding platform of the table is conjunctly displaced such as to cover the container outlet 1904. Covering the container outlet 1904 prevents any remaining content of the container from flowing out of the container or contaminants from entering the container, without necessitating a valve at the outlet. Once the container outlet is covered, mixing of the content container 1906 is restarted to prevent feedstock deterioration or segregation. During the mixing 1906, the vacuum to the container is applied 1908. Following the alignment of the injection cylinder with the mold inlet 1902, the piston of the injection cylinder is displaced towards the mold inlet 1910 in order to inject feedstock therein. Once the feedstock is solidified within the mold, the resulting part is retrieved from the mold 1914.

It shall be recognized that in the method of injecting the feedstock into a mold 1606, various steps can take place simultaneously without departing from the scope of the method 1606. For instance, the aligning 1902 and the covering 1904 can take place simultaneously. Also, the mixing 1906 and applying vacuum 1908 can take place simultaneously. Moreover, the mixing 1906 and the displacing piston 1910 can also take place simultaneously. Moreover, the displacing piston 1910 and the injecting feedstock 1912 can also take place simultaneously.

Figure 20:
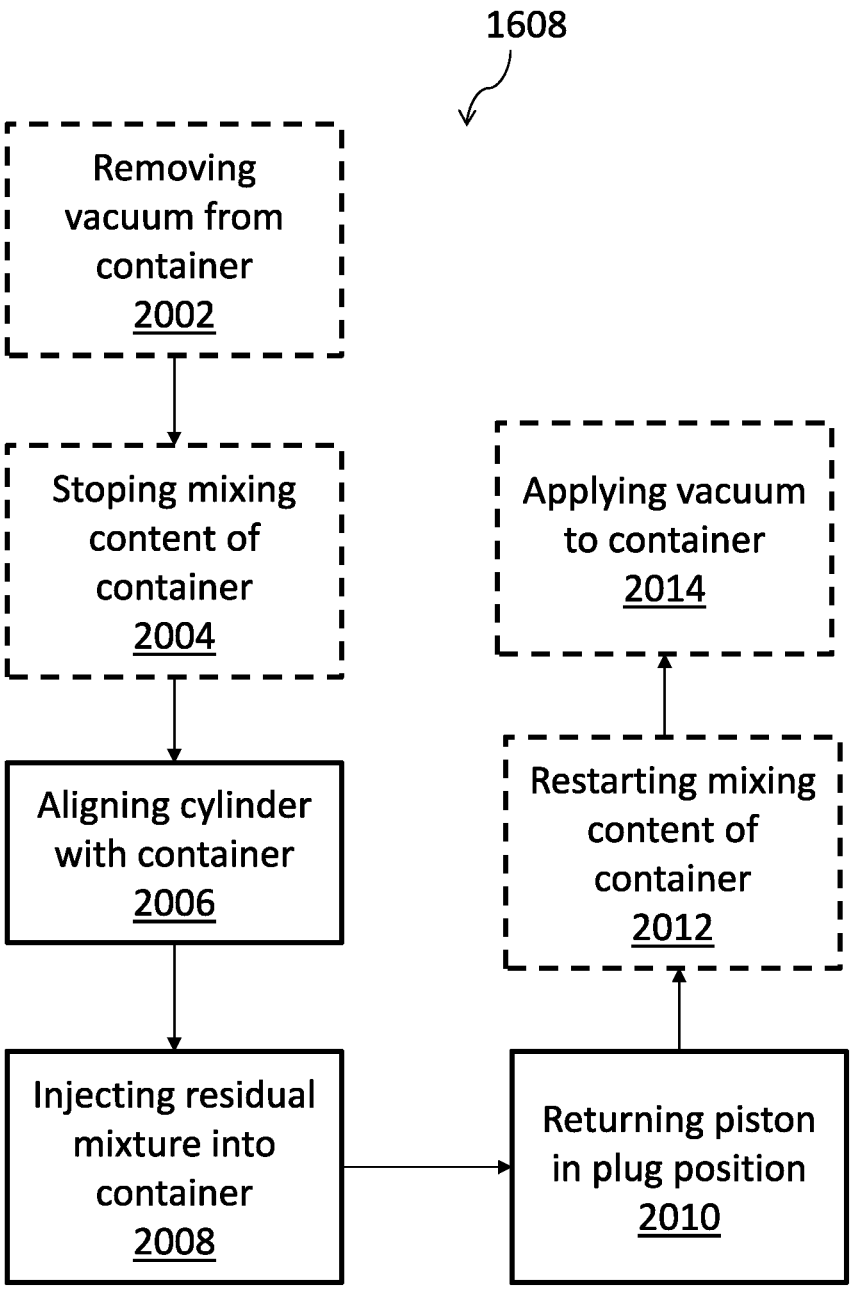
FIG. 20, illustrates a block diagram describing a method of emptying an injection cylinder, according to one embodiment.

FIG. 20 presents a method for emptying the injection cylinder of residual feedstock 1608. The method 1608 consists of removing the vacuum from the container 2002 and stopping the mixing of the content of the container 2004. The method 1608 further consists of aligning the cylinder with the container 2006, from a mold alignment position to a container alignment position, as concurrently presented in FIG. 15*f*. Then injecting the residual feedstock into the container 2008 by returning the piston of the injection cylinder into the original container plugging position 2010, as concurrently presented in FIGS. 15*g* and 15*h*. This way, any residual feedstock within the injection cylinder can be mixed again and used at a later time or in a next injection cycle. For a next injection cycle, the method 1608 further consists of restarting mixing of the content of the container 2012 and applying the vacuum to the container 2014.

It shall be recognized that in the method for emptying the injection cylinder of residual feedstock 1608, various steps can take place simultaneously without departing from the scope of the method 1608. For instance, the removing vacuum 2002 and the stopping mixing 2004 can take place simultaneously. Also, the stopping mixing 2004 and the aligning cylinder 2006 can take place simultaneously. Moreover, the injecting residual feedstock 2008 and the returning piston 2010 can take place simultaneously. Moreover, the restarting mixing 2012 and the applying vacuum 2014 can take place simultaneously.

It shall further be understood that in the methods of mixing feedstock 1602, filing the injection cylinder 1604, injecting feedstock into the mold 1606 and emptying the injection cylinder 1608, the application or removal of the vacuum at steps 1716, 1802, 1908, 2002 and 2014 is optional depending at least in part on the type or quantity of feedstock, the shape and size of the container 210, the shape and size of the mixing tool 902 or the level of air bubble acceptance threshold.

It shall also be understood that in the methods of filling the injection cylinder 1604, injecting feedstock into the mold 1606 and emptying the injection cylinder 1608, the mixing of the content of the container or the stopping thereof at steps 1804, 2004 or 2012 is optional depending at least in part on the type or quantity of feedstock, the shape and size of the container 210, the shape and size of the mixing tool 902 or the level of air bubble acceptance threshold.

In this embodiment, as can be noticed with FIGS. 15*d* and 15*f*, it is the injection cylinder that is displaced from a container alignment position to a mold alignment position and vice versa. However it is very well possible in an alternate embodiment, that the injection cylinder remains fixed and that the container and mold are displaced accordingly in an injection cylinder alignment position for respectively filling the injection cylinder 1812, injecting the feedstock into the mold 1906 and injecting the feedstock back into the container 2004.

Moreover as can be noticed in FIGS. 15*a* and 15*b*, in this embodiment, it is the piston of the injection cylinder that serves as a plug to the container during the mixing 1714. However it shall be understood that in an alternate embodiment, the sliding platform serves as a plug as shown in FIGS. 15*d* and 15*f*, for instance. Indeed, during mixing 1714 the injection cylinder need not be aligned with the container and the piston need not be in a container plugging position. In fact, the mixing 1714 can continue to take place even while the injection cylinder is being displaced as in FIGS. 15*d* and 15*f*.

Moreover as can be noticed in FIG. 15*a*, the mixer is retracted 1702 for allowing insertion of powder and binder into the container. However it shall be understood that the powder and binder can be inserted by any other suitable means, without requiring the retraction of the mixer. For instance, the container can be filled with powder and binder from the outlet or by a dedicated channel that can be plugged or removed during the mixing 1714.

The above description embodiments are meant to be exemplary only, and the skilled person in the art will recognize that changes may be made to the embodiments described without departing from the scope of the invention disclosed. For instance, the above described embodiments may be operative disregarding the dimension, shape and orientation of the various components in the molding machine 100.

For instance, although the above embodiments describe a low-pressure powder injection molding machine, it shall be recognized that the feedstock could be injected into the mold with any suitable pressure such as a moderate pressure or a high pressure depending of the mold shape and size, without departing from the claimed injection molding machine.

The invention claimed is:

1. A low-pressure powder injection molding machine comprising a feedstock container adapted to contain a mixed feedstock material, a mold having an inlet, a cavity in which said feedstock material can set and an injection device having an injection port for supplying said mixed feedstock material from said container to said mold by using pressure, wherein said machine further comprises a moveable platform providing relative movement between said injection port of said injection device and said inlet of said mold so that said feedstock is communicated directly between said injection port and said inlet without an intermediary conduit, wherein said moveable platform is mounted on a base structure, the moveable platform being displaceable with respect to the base structure, along a platform displacement path;

said injection device is adapted to be mounted on the moveable platform, the injection device having an injection cylinder that is adapted to fill up, at least in part, with a feedstock when in a container alignment position and that is adapted to inject the feedstock when in a mold alignment position according to a propulsion system within the injection cylinder;

said mold is adapted to be placed on the moveable platform and immobilized with respect to the base structure along the platform displacement path when the injection device is in a mold alignment position, the mold defining a cavity and the inlet, the cavity being for receiving the feedstock and forming a part according to a desired shape, the inlet being in communication with the cavity for transmitting the feedstock from the injection device to the cavity, the inlet being positioned to align with the injection device when in the mold alignment position;

said container adapted to be placed on the moveable platform and immobilized with respect to the base structure along the platform displacement path, the container defining a chamber and the outlet that is in communication with the chamber, the chamber being adapted to receive at least one material to produce the feedstock, the chamber being further adapted to receive a mixing tool and also adapted to contain the feedstock therein, the outlet being positioned to align with the injection cylinder when in the container alignment position; and Said container further comprises a mixer having the mixing tool, the mixer being adapted to be displaceably mounted on the base structure so as to engage the container with the mixing tool.

2. The low-pressure powder injection molding machine as defined in claim 1, wherein said container comprises an outlet, and wherein said moveable platform provides movement of said injection device between said outlet and said inlet of said mold.

3. The low-pressure powder injection molding machine as defined in claim 2, wherein said moveable platform has a flange adapted to contact the outlet and seal the outlet in order to prevent feedstock from flowing out.

4. The low-pressure powder injection molding machine as defined in claim 1, wherein said moveable platform provides a linear movement.

5. The low-pressure powder injection molding machine of claim 1 wherein the propulsion system is a piston.

6. The low-pressure powder injection molding machine of claim 5 wherein the piston is adapted to plug the outlet of the container when in the container alignment position.

7. The low-pressure powder injection molding machine of claim 1 wherein the injection device is integral with the container.

8. The low-pressure powder injection molding machine of claim 1 wherein the container is immobilized by the engaged mixer.

9. The low-pressure powder injection molding machine of claim 3 wherein the moveable platform is heated in order to maintain feedstock residue in a molten state.

10. The low-pressure powder injection molding machine of claim 1 wherein the mixer defines an inspection shaft that is aligned with a center portion of the feedstock container.

11. The low-pressure powder injection molding machine of claim 10 wherein the inspection shaft is adapted to provide passage for an inspection tool.

12. The low-pressure powder injection molding machine of claim 1 wherein the injection cylinder is removeable.

13. The low-pressure powder injection molding machine of claim 12 wherein the injection cylinder is interchangeable.

14. The low-pressure powder injection molding machine of claim 1 further comprising a control system having at least one of the group consisting of:

an injection device displacement controller adapted to control a displacement of the moveable platform along the platform displacement path;

an injection cylinder controller adapted to control a displacement of the piston for filling the injection cylinder with feedstock and for injecting feedstock;

a mixer controller adapted to control a displacement of the mixer from a container withdrawn position to a container engaging position;

a mixing tool controller adapted to control the mixing tool when the mixer is in the container engaging position; and a mold controller adapted to immobilize the mold on the moveable platform and to release the mold from the moveable platform.

15. The low-pressure powder injection molding machine of claim 14 wherein the control system is associated to a user interface adapted to display a status of the molding machine and receive input to control the molding machine.

16. A method of producing a molded part, the method comprising:

providing a low-pressure powder injection molding machine of claim 1;

mixing a feedstock within said container;

aligning said injection cylinder with the outlet of the container;

filing the injection cylinder with the feedstock by displacing the piston of the cylinder away from the outlet;

aligning the injection cylinder with the inlet of the mold; and injecting the feedstock into the inlet by displacing the piston towards the inlet for transferring the feedstock within the mold cavity;

hardening of the feedstock within the mold cavity; and retrieving the hardened feedstock from the mold.

17. The method of claim 16 wherein the aligning the injection cylinder with the outlet of the container further comprises plugging the outlet of the container with a piston of the injection cylinder.

18. The method of claim 16 wherein the aligning the injection cylinder with the outlet of the container is performed prior to the mixing.

19. The method of claim 16 further comprising aligning the injection cylinder with the outlet of the container and injecting unused feedstock back into the container.

20. The method of claim 16 wherein the injecting the feedstock into the inlet is performed with low pressure.

* * * * *